US007823815B2

(12) United States Patent
Jensen

(10) Patent No.: US 7,823,815 B2
(45) Date of Patent: Nov. 2, 2010

(54) SHREDDER WITH SELF ADJUSTING SENSOR

(75) Inventor: Michael D. Jensen, Wood Dale, IL (US)

(73) Assignee: Fellowes, Inc., Itasca, IL (US)

( * ) Notice: Subject to any disclaimer, the term of this patent is extended or adjusted under 35 U.S.C. 154(b) by 206 days.

(21) Appl. No.: 12/252,158

(22) Filed: Oct. 15, 2008

(65) Prior Publication Data

US 2010/0090038 A1 Apr. 15, 2010

(51) Int. Cl.
*B02C 4/32* (2006.01)
*B02C 7/14* (2006.01)

(52) U.S. Cl. ..... 241/36; 241/37.5; 241/100; 241/236

(58) Field of Classification Search ..... 241/36, 241/37.5, 100, 236
See application file for complete search history.

(56) References Cited

U.S. PATENT DOCUMENTS

| | | | | |
|---|---|---|---|---|
| 3,882,770 | A | 5/1975 | Bleasdale | |
| 4,650,128 | A | 3/1987 | Goldhammer | |
| 5,039,020 | A * | 8/1991 | Leuthold et al. | 241/30 |
| 5,102,057 | A | 4/1992 | Ellis, III | |
| 5,167,374 | A | 12/1992 | Strohmeyer | |
| 5,318,229 | A | 6/1994 | Brown | |
| 5,342,582 | A * | 8/1994 | Horn et al. | 422/105 |
| 5,375,781 | A | 12/1994 | Schwelling | |
| 5,464,162 | A | 11/1995 | Kusters | |
| 5,897,065 | A | 4/1999 | Schwelling | |
| 5,934,584 | A | 8/1999 | Schwelling | |
| 6,978,954 | B2 | 12/2005 | Kroger | |
| 7,040,559 | B2 | 5/2006 | Matlin | |
| 7,204,441 | B1 | 4/2007 | Hartnett | |
| 2007/0221768 | A1 | 9/2007 | Wang | |
| 2007/0267525 | A1 | 11/2007 | Wang | |
| 2010/0176229 | A1 | 7/2010 | Huang et al. | |

FOREIGN PATENT DOCUMENTS

| | | |
|---|---|---|
| DE | 100 32 069 A1 | 2/2002 |
| JP | 2-303550 | 12/1990 |
| JP | H2-303550 A | 12/1990 |
| JP | 2002-85994 | 10/2002 |

(Continued)

OTHER PUBLICATIONS

Multi-Touch Sensing through LED Matrix Displays, Video on website http://cs.nyu.edu/~jhan/ledtouch/indes.html, Dec. 2, 2008.

(Continued)

*Primary Examiner*—Bena Miller
(74) *Attorney, Agent, or Firm*—Pillsbury Winthrop Shaw Pittman LLP

(57) ABSTRACT

Disclosed herein is a shredder having a throat for receiving at least one article to be shredded therethrough and a shredder mechanism received in a shredder housing which is driven to shred the at least one article fed therein. At least one sensor emits and detects radiation to detect the presence of the at least one article or shredded particles. The sensor communicates with a controller to operate the shredder mechanism. The controller also calibrates an intensity of the radiation of the sensor(s) to or within a predetermined amount above a minimum level in order to reduce wear and run-on conditions.

33 Claims, 13 Drawing Sheets

FOREIGN PATENT DOCUMENTS

| | | | |
|---|---|---|---|
| KR | 20050123006 | A | 12/2005 |
| KR | 1020040048706 | A | 12/2005 |

OTHER PUBLICATIONS

Dietz et al., "Very Low-cost Sensing and Communication Using Bidirectional LEDs", Mitsubishi Electric Research Laboratories, Cambridge, Massachussetts.

Gadre et al., "LED Senses and Displays Ambient Light Intensity", Sep. 14, 2006, 3 pages.

Motestruments!, Internet search; http://web.archive.org.web/20060604000250/http:/motestruments.com/led-touch-sensor-circuit/, Dec. 18, 2008, 3 pages.

Kyle Holland, "LED doubles as emitter and detector", EDN, Aug. 16, 2001, 2 pages.

Gadre et al., "LED senses and displays ambient-light intensity", article from Internet: http://www.edn.com/index.asp?layout=article&articleid=CA6387024, Jul. 22, 2008, 4 pages.

JustDIY Project Log, Internet search: http://projects.dimension-x.net/technology-and-projects/ledsensors; Jul. 29, 2008, 3 pages.

British Search Report for Great Britain Patent Application No. GB0917581.1, mailed on Jan. 8, 2010.

* cited by examiner

SHREDDER WITH SELF ADJUSTING SENSOR

BACKGROUND OF THE INVENTION

1. Field of Invention

The present invention is generally related to a shredder having cutter elements for shredding articles. In particular, the apparatus comprises at least one sensor and controller for enabling operation of the cutter elements.

2. Background

A common type of shredder has a shredder mechanism contained within a housing and mounted atop a container. The shredder mechanism typically includes a cutting head assembly including a series of cutter elements that shred articles such as paper, CDs, DVDs, credit cards, and the like that are fed therein and discharge the shredded articles downwardly into the container. An example of such a shredder may be found, for example, in U.S. Pat. No. 7,040,559, which is herein incorporated by reference in its entirety.

When users feed articles into the shredder mechanism, a sensor may be provided to detect the presence of such articles, thereby activating the shredder mechanism to shred the articles. One or more sensors may also be provided to detect if the container is full of shredded articles. Optical sensors are commonly used because they have no moving parts. However, the optical sensors used in shredders preferably have a wide range of electrical characteristics and/or sensitivities to detect the wide range of articles and media (e.g., articles of various colors, materials), without providing any false positive signals for activating the shredder mechanism during the life of the sensor. For example, the drive signal of the sensor must provide an intensity of light that is sensitive to detect both paper and CDs and/or shredded articles. Traditionally, in activation sensors, for example, the strength of the drive signal of the sensor has been dictated by a single sheet of paper. If the drive signal is too strong, the shredder would not reliably detect a single sheet of paper. If the drive signal is too weak, however, the machine may detect a false positive, and perhaps activate the cutters of the shredder mechanism to rotate when it is not needed. Conversely, with bin-full sensors, the machine may deactivate the cutters when it is not needed. The addition of paper dust and oil residues on the components of the shredder mechanism further complicate this matter by reducing the perceived intensity of sensor, thus promoting false positive signals. In particular, when false positive signals occur with sensors for detecting the presence of a single sheet of paper, the shredder mechanism may run indefinitely, causing a "run-on" condition that is annoying and inconvenient for users or consumers. When false positive signals occur with sensors detecting the container being full with shredded articles, the shredder mechanism may not run, also causing frustration to users.

SUMMARY OF THE INVENTION

One aspect of the invention provides a shredder including a shredder housing having a throat for receiving at least one article to be shredded therethrough and a shredder mechanism received in the housing. The shredder mechanism includes a motor and cutter elements, and enables the at least one article to be shredded to be fed into the cutter elements. The motor is operable to drive the cutter elements in a shredding direction so that the cutter elements shred the at least one article fed therein into particles. The shredder also includes a sensor for emitting and detecting radiation. The sensor consists of either (a) a throat sensor operable to detect insertion of the at least one article into the throat based on interruption of the radiation by the at least one article, or (b) a waste level sensor operable to detect an accumulation of shredded particles discharged by the shredder mechanism based on an interruption of the radiation on the accumulated shredded particles. A controller coupled to the sensor and the shredder mechanism is operable to control an operation of the shredder mechanism upon detection by the sensor. The controller is configured to perform an automatic calibration wherein an intensity of the radiation emitted by the sensor is adjusted to or within a predetermined amount at or above a minimum level (a) when no article is present in the throat or (b) when no shredded particles are accumulated.

Another aspect of the invention provides a method for operating a shredder. The shredder includes a shredder housing having a throat for receiving at least one article to be shredded, a sensor, and a shredder mechanism received in the shredder housing. The sensor emits and detects radiation, and is either (a) a throat sensor operable to detect insertion of the at least one article into the throat based on interruption of the radiation by the at least one article, or (b) a waste level sensor operable to detect an accumulation of shredded particles discharged by a shredder mechanism based on interruption of the radiation on the accumulated shredded particles. The shredder also includes a motor operable to drive cutter elements in a shredding direction so that the cutter elements shred the at least one article fed therein into particles. The method includes: emitting and detecting a radiation beam with the sensor; detecting with the sensor the at least one article or the shredded particles based on an interruption of the radiation beam by the at least one article or the shredded particles; operating the motor to drive the cutter elements in a shredding direction, and performing an automatic calibration of the radiation beam wherein an intensity of the radiation is adjusted to or within a predetermined amount at or above a minimum level.

Another aspect of the invention includes a shredder includes a shredder housing having a throat for receiving at least one article to be shredded therethrough, and a shredder mechanism received in the housing. The shredder mechanism includes a motor and cutter elements, and enables the at least one article to be shredded to be fed into the cutter elements. The motor is operable to drive the cutter elements in a shredding direction so that the cutter elements shred the at least one article fed therein into particles. The shredder also includes a container for receiving shredded particles. A sensor is positioned in the shredder to receive radiation reflected off of shredded particles deposited in the container, and determine an intensity of the reflected radiation. The intensity of the reflected radiation corresponds to an amount of shredded particles deposited in the bin. A controller is coupled to the sensor and the shredder mechanism. The controller is operable to determine an operation of the shredder mechanism upon detection of the at least one article or the shredded particles by the sensor. An intensity of the radiation is set to or within a predetermined amount at or above a minimum level that is detectable by the sensor. The minimum level is determined by adjusting the intensity of the radiation within a specified range.

Other objects, features, and advantages of the present invention will become apparent from the following detailed description, the accompanying drawings, and the appended claims.

DETAILED DESCRIPTION OF THE PREFERRED EMBODIMENT(S) OF THE INVENTION

The following embodiments are described with reference to the drawings and are not to be limiting in their scope in any manner.

Figure 1:
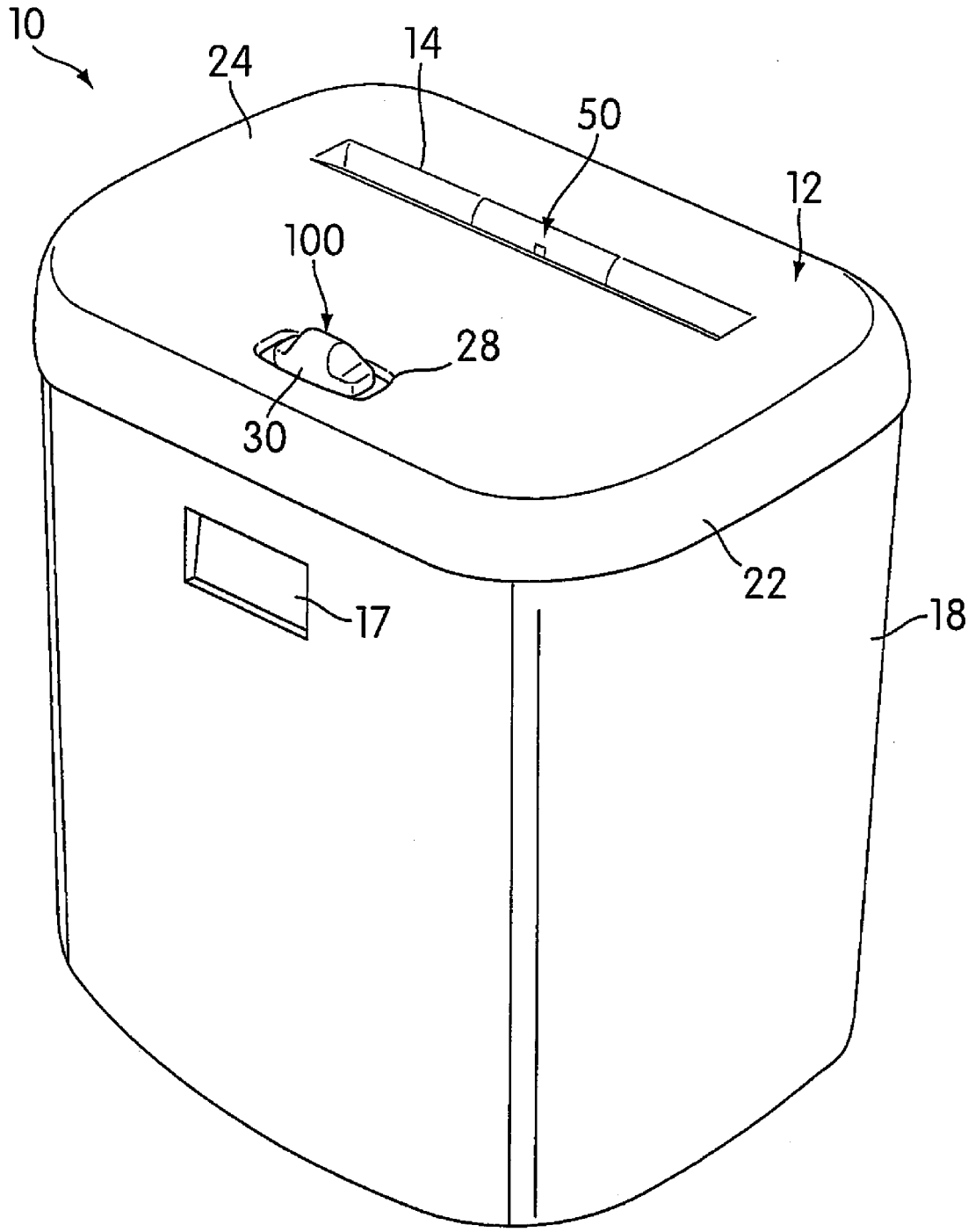
FIG. 1 is a top perspective view of a shredder apparatus constructed in accordance with an embodiment of the present invention.

FIG. 1 is a top perspective view of a shredder apparatus 10 constructed in accordance with an embodiment of the present invention. The shredder 10 is designed to destroy or shred articles such as paper, paper products, CDs, DVDs, credit cards, and other objects. In an embodiment, the shredder 10 may comprise wheels (not shown) to assist in moving the shredder 10. The shredder 10 comprises a shredder housing 12 that sits on top of a container 18, for example. The shredder housing 12 comprises at least one input opening 14 on an upper side 24 (or upper wall or top side or top wall) of the housing 12 for receiving materials to be shredded. The input opening 14 extends in a lateral direction, and is also often referred to as a throat. The input opening or throat 14 may extend generally parallel to and above a shredder mechanism 20 (described below). The input opening or throat 14 may be relatively narrow, so as to prevent overly thick items, such as large stacks of documents, from being fed into therein. However, the throat 14 may have any configuration. In an embodiment, an additional or second input opening (not shown) may be provided in shredder housing 12. For example, input opening 14 may be provided to receive paper, paper products, and other items, while second input opening (not shown) may be provided to receive objects such as CDs and DVDs. Shredder housing 12 also comprises an output opening 16 on a lower side 26 (or bottom side or bottom wall or underside or bin side). In an embodiment, shredder housing 12 may include a bottom receptacle 38 with lower side 26 to receive shredder mechanism 20 therein. Bottom receptacle 38 is affixed to the underside of the upper side 24 or top wall base fasteners, for example. The receptacle 38 has output opening 16 in its bottom side 26 or bottom wall through which shredded particles are discharged. Generally speaking, the shredder 10 may have any suitable construction or configuration and the illustrated embodiments provided herein are not intended to be limiting in any way. In addition, the term "shredder" or "shredder apparatus," used interchangeably throughout this specification, are not intended to be limited to devices that literally "shred" documents and articles, but instead intended to cover any device that destroys documents and articles in a manner that leaves such documents and articles illegible and/or useless.

As noted, the shredder 10 also comprises a shredder mechanism 20 (shown generally in FIG. 3) in the shredder housing 12. When articles are inserted into the at least one input opening or throat 14, they are directed toward and into shredder mechanism 20. "Shredder mechanism" is a generic structural term to denote a device that destroys articles using at least one cutter element. Destroying may be done in any particular way. Shredder mechanism 20 includes a drive system 32 (generally shown in FIG. 2) with at least one motor 34, such as an electrically powered motor, and a plurality of cutter elements 21. The cutter elements 21 are mounted on a pair of parallel mounting shafts (not shown). The motor 34 operates using electrical power to rotatably drive first and second rotatable shafts of the shredder mechanism 20 and their corresponding cutter elements 21 through a conventional transmission 36 so that the cutter elements 21 shred or destroy materials or articles fed therein, and, subsequently, deposit the shredded materials into opening 15 of container 18 via the output opening 16. The shredder mechanism 20 may also include a sub-frame for mounting the shafts, motor, and transmission. The drive system may have any number of motors and may include one or more transmissions. Also, the plurality of cutter elements 21 are mounted on the first and second rotatable shafts in any suitable manner. For example, in an embodiment, the cutter elements 21 are rotated in an interleaving relationship for shredding paper sheets and other articles fed therein. In an embodiment, the cutter elements 21 may be provided in a stacked relationship. The operation and construction of such a shredder mechanism 20 is well known and need not be discussed herein in detail. As such, the at least one input opening or throat 14 is configured to receive materials inserted therein to feed such materials through the shredder mechanism 20 and to deposit or eject the shredded materials through output opening 16.

Figure 2:
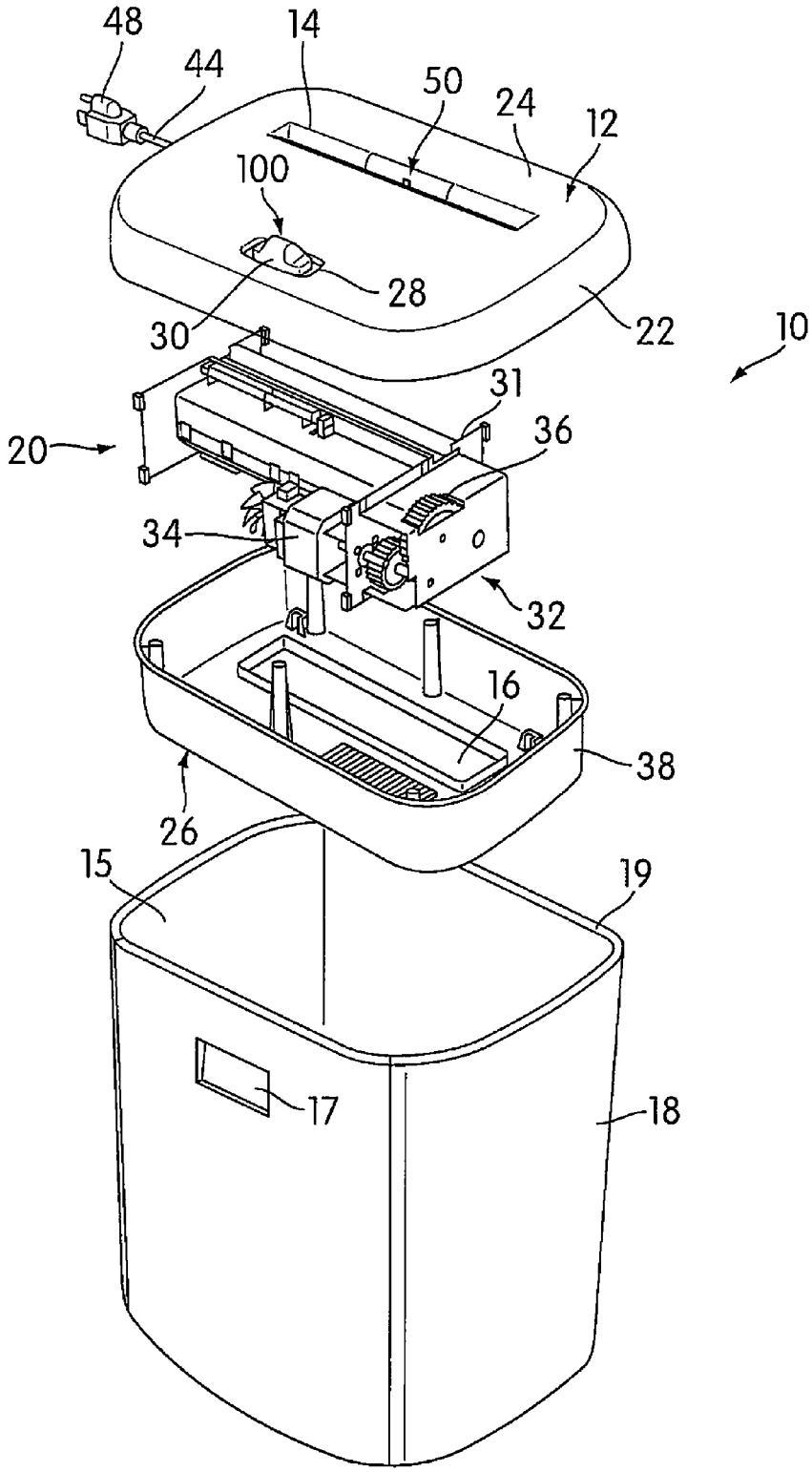
FIG. 2 is an exploded perspective view of FIG. 1.

Shredder housing 12 is configured to be seated above or upon the container 18. As shown in FIG. 2, shredder housing 12 may comprise a detachable paper shredder mechanism. That is, in an embodiment, the shredder housing 12 may be removed in relation to the container 18 to ease or assist in emptying the container 18 of shredded materials. In an embodiment, shredder housing 12 comprises a lip 22 or other structural arrangement that corresponds in size and shape with a top edge 19 of the container 18. The container 18 receives paper or articles that are shredded by the shredder 10 within its opening 15. More specifically, after inserting materials into input opening 14 for shredding by cutter elements 21, the shredded materials or articles are deposited from the output opening 16 on the lower side 26 of the shredder housing 12 into the opening 15 of container 18. The container 18 may be a waste bin, for example.

In an embodiment, the container 18 may be positioned in a frame beneath the shredder housing 12. For example, the frame may be used to support the shredder housing 12 as well as comprise a container receiving space so that the container 18 may be removed therefrom. For example, in an embodiment, a container 18 may be provided to slide like a drawer with respect to a frame, be hingedly mounted to a frame, or comprise a step or pedal device to assist in pulling or removing it therefrom. Container 18 may comprise an opening or recess 17 to facilitate a user's ability to grasp the bin (or grasp an area approximate to recess 17), and thus provide an area for the user to easily grasp to separate the container 18 from the shredder housing 12, thereby providing access to shredded materials. The container 18 may be substantially or entirely removed from being in an operative condition with shredder housing 12 in order to empty shredded materials such as chips or strips (i.e., waste or trash) located therein. In an embodiment, the container or bin 18 may comprise one or more access openings (not shown) to allow for the deposit of articles therein.

Generally the terms "container," "waste bin," and "bin" are defined as devices for receiving shredded materials discharged from the output opening 16 of the shredder mechanism 20, and such terms are used interchangeably throughout this specification. However, such terms should not be limiting. Container 18 may have any suitable construction or configuration.

Typically, the power supply to the shredder 10 will be a standard power cord 44 with a plug 48 on its end that plugs into a standard AC outlet. Also, a control panel may be provided for use with the shredder 10. Generally, the use of a control panel is known in the art. As shown in FIG. 1, a power switch 100 or a plurality of switches may be provided to control operation of the shredder 10. The power switch 100 may be provided on the upper side 24 of the shredder housing 12, for example, or anywhere else on the shredder 10. The upper side 24 may have a switch recess 28 with an opening therethrough. An on/off switch 100 includes a switch module (not shown) mounted to housing 12 underneath the recess 28 by fastening devices, and a manually engageable portion 30 that moves laterally within recess 28. The switch module has a movable element (not shown) that connects to the manually engageable portion 30 to move the switch module between its states. Movement of the manually engageable portion of switch 100 moves the switch module between states. In the illustrated embodiment shown in FIG. 2, the switch module connects the motor 34 to the power supply. This connection may be direct or indirect, such as via a controller 56. The term "controller" is used to define a device or microcontroller having a central processing unit (CPU) and input/output devices that are used to monitor parameters from devices that at operatively coupled to the controller. The input/output devices also permit the CPU to communicate and control the devices (e.g., such as a sensor 50 or the motor 34) that are operatively coupled to the controller. As is generally known in the art, the controller may optionally include any number of storage media such as memory or storage for monitoring or controlling the sensors coupled to the controller.

Figure 5:
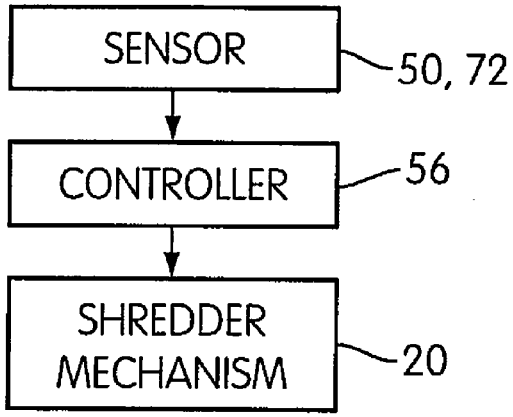
FIG. 5 is a schematic illustration of interaction between a controller and other parts of the shredder in accordance with an embodiment of the present invention.

The controller 56 likewise communicates with the motor 34 of the shredder mechanism 20 (shown schematically in FIG. 5). When the switch 100 is moved to an on position, the controller 56 can send an electrical signal to the drive of the motor 34 so that it rotates the cutting elements 21 of the shredder mechanism 20 in a shredding direction, thus enabling paper sheets to be fed in the throat 14 to be shredded. Additionally or alternatively, when the switch 100 is in an on position, the switch 100 may be set to an idle or ready position, which communicates with the control panel. The idle or ready position may correspond to selectively activating the shredder mechanism 20, for example. As will be further described below, the controller 56 may selectively enable the operation of the shredder mechanism 20 based on the detection of the presence or insertion of at least one article (e.g., paper) in the throat 14 by an activation sensor 50. Also, in an embodiment, the controller 56 may selectively enable the operation of shredder mechanism 20 based on one or more waste level or bin full sensing devices 72 or 76 which determine if the container 18 is accumulating shredded particles or full of shredded particles. The switch 100 may also be moved to an off position, which causes the controller 56 to stop operation of the motor 34.

The switch module contains appropriate contacts for signaling the position of the switch's manually engageable portion. As an option, the switch 100 may also have a reverse position that signals the controller 56 to operate the motor 34 in a reverse manner. This would be done by using a reversible motor and applying a current that is of reverse polarity relative to the on position. The capability to operate the motor 34 in a reversing manner is desirable to move the cutter elements 21 in a reversing direction for clearing jams, for example. To provide each of the noted positions, the switch 100 may be a sliding switch, a rotary switch, or a rocker switch. Also, the switch 100 may be of the push switch type that is simply depressed to cycle the controller 56 through a plurality of conditions. Additionally, the controller 56 may determine that throat 14 (e.g., via one or more sensors 50) is not clear of articles, and, thus, operate the motor 34 in a reverse direction (e.g., for a short period of time) so as to clear any remaining articles (or parts thereof) from the throat 14 of the shredder 10.

Generally, the construction and operation of the switch 100 and controller 56 for controlling the motor are well known and any construction for these may be used. For example, a touch screen switch, membrane switch, or toggle switches are other examples of switches that may be used. Also, the switch need not have distinct positions corresponding to on/off/idle/reverse, and these conditions may be states selected in the controller by the operation of the switch. Any of the conditions could also be signaled by lights, on a display screen, or otherwise.

In some embodiments, a bin level detection system for indicating the level of accumulated shredded particles may be provided on shredder housing 12 of shredder 10, such as described in U.S. application Ser. No. 12/184,631, filed Aug. 1, 2008, assigned to the same assignee, which is herein incorporated by reference in its entirety.

Figure 3:
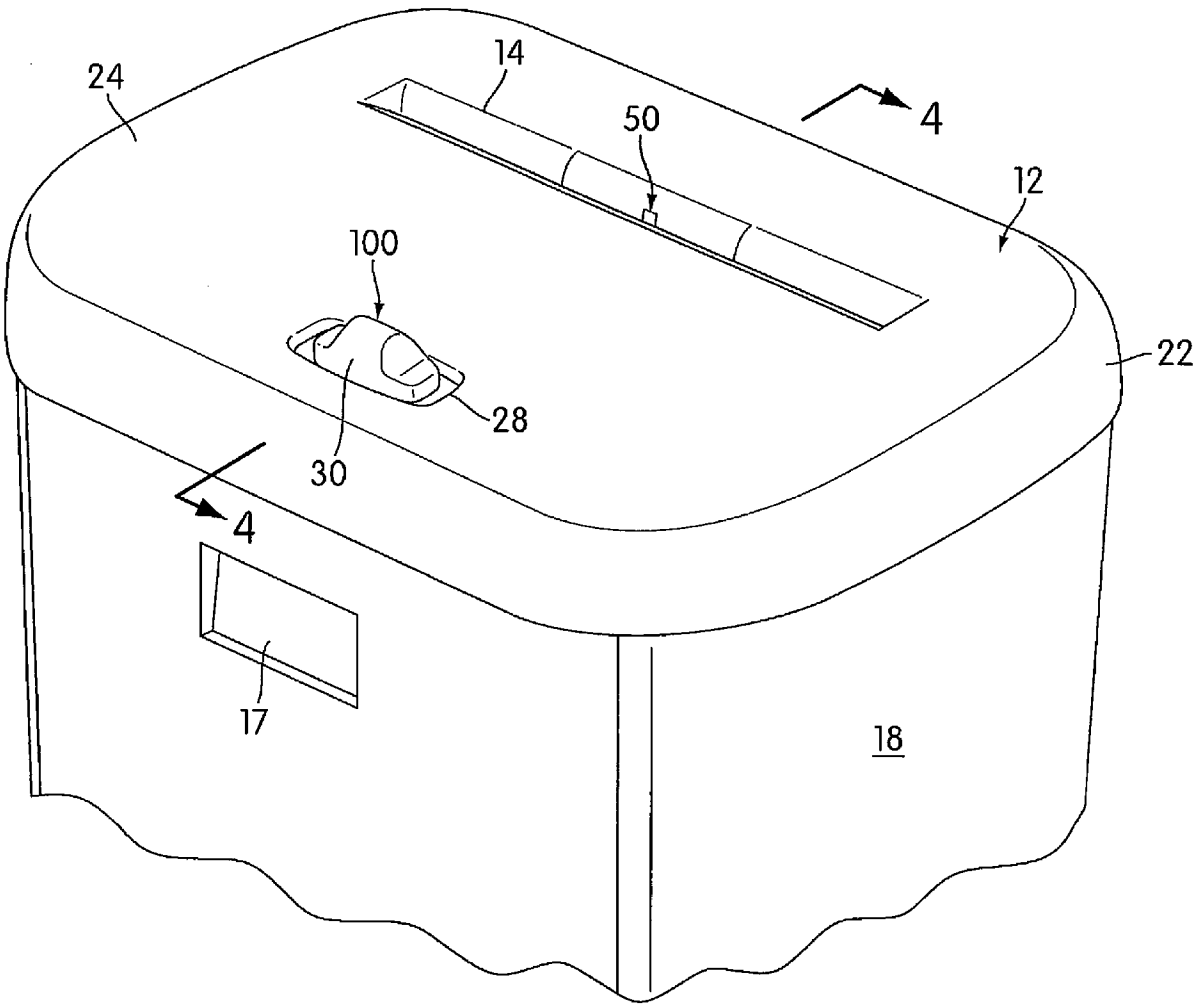
FIG. 3 is a detailed perspective view of FIG. 1.

As noted, shredder 10 may have one or more activation sensors 50. For explanatory purposes only, a single activation sensor 50 is illustrated. However, any number of sensors 50 may be provided. When the switch 100 is in its on (or idle) position, the controller 56 may be configured to operate the motor 34 to drive the cutter elements 21 of shredder mechanism 20 in the shredding direction when the activation sensor 50 is triggered and detects the presence or insertion of at least one article to be shredded. In some embodiments, as shown in FIGS. 1 and 3, activation sensor 50 is provided in throat 14.

Activation sensor 50 emits and detects radiation and is operable to detect the presence or insertion of at least one article based on the interruption of the radiation by the at least one article. In some embodiments, sensor 50 comprises a light-emitting element or emitter 52 and a light detecting element or detector 54. The term "light-emitting element" or "emitter" is used to define any device that emits radiation, and may also be referred to as a transmitter, for example. The term "light-detecting element" or "detector" is used to define any device that detects or receives radiation, e.g., from the emitter 52, and may also be referred to as a receiver, for example. In some embodiments, as will be further described below, the sensor 50 may be single, dual-function device for emitting and detecting radiation (e.g., a light-emitting diode or LED), or alternatively, comprises a plurality of LEDs. Radiation may include, but not be limited to, visible light, infrared (IR) light, and ultraviolet light, or any combination thereof. For example, activation sensor 50 may be an optical IR sensor.

Figure 4:
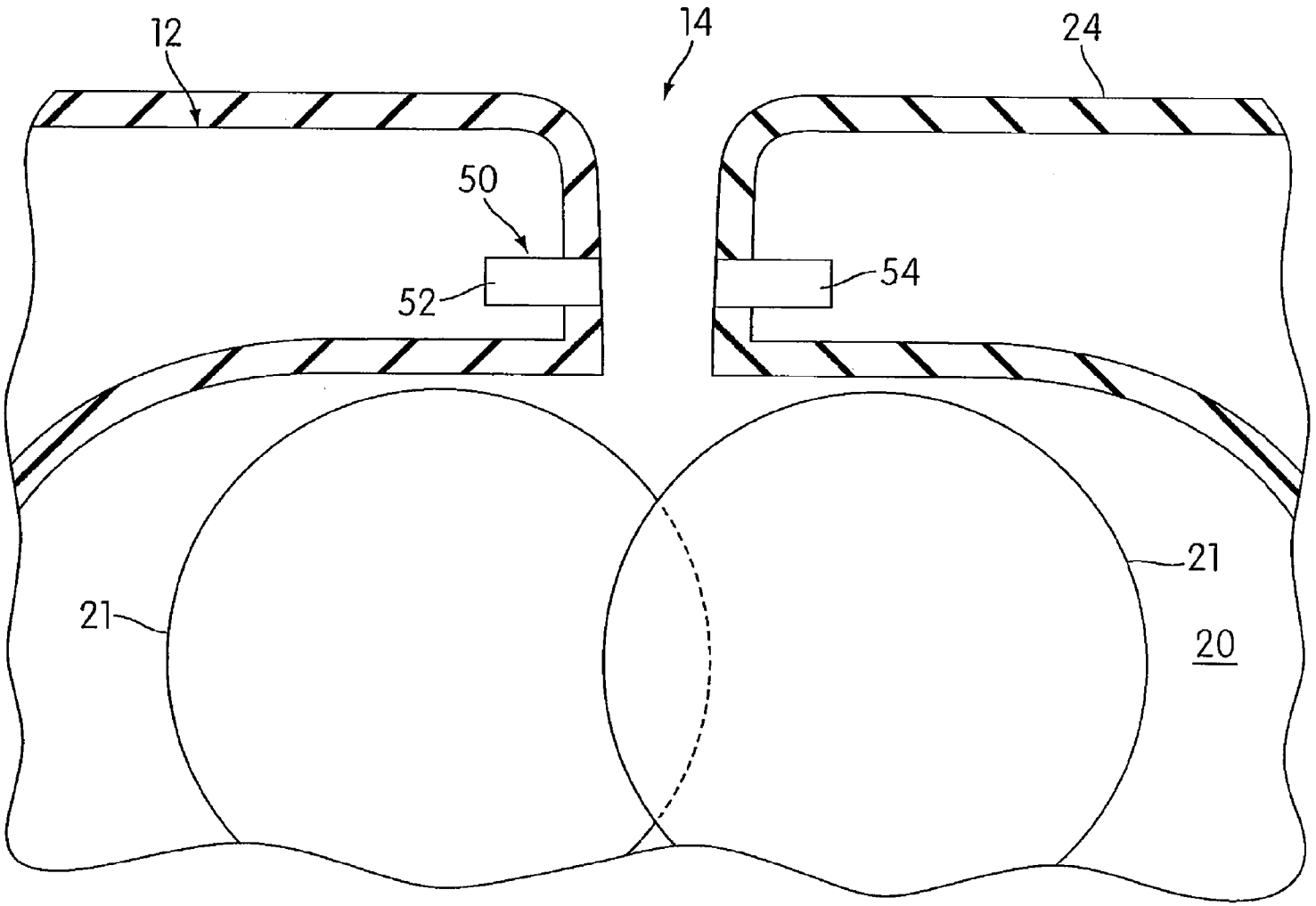
FIG. 4 is a cross-section of FIG. 3 showing a schematic illustration of a sensor operable to detect the presence of article(s) to be shredded by the shredder in accordance with an embodiment of the present invention.

As shown in FIG. 4, in an embodiment, an emitter 52 and detector 54 are located within the throat 14. Specifically, the emitter 52 and detector 54 are located below the upper wall 24 and above the cutter elements 21 of shredder mechanism 20. However, as shown and described with reference to FIGS. 8 and 9, the location of the sensor 50 and/or emitter and detector 54 should not be limited. The sensor 50 and/or emitter 52 and detector 54 may be provided in any number of locations in relation to shredder housing 12 or shredder mechanism 20.

Referring back to FIG. 4, the emitter 52 emits radiation or light (e.g., an IR beam) to the detector 54 across the input opening or throat 14. The detector 54 detects the radiation across the throat 14. The controller 56 determines whether the throat 14 is clear of articles through the radiation. If the controller 56 determines that the radiation is uninterrupted and the throat 14 is clear of articles, the controller 56 zeroes the sensor 50. The "zero position" of sensor 50 is defined as a position the sensor assumes when the shredder 10 is powered on with no article(s) being present (e.g., without an article being inserted into the throat 14). When at least one article such as paper is inserted into the throat 14, the article will interrupt the radiation or light beam. The interruption of the radiation is sensed by the detector 54, which communicates the event to the controller 56. Assuming that the switch 100 is in an on (or idle) position, the controller 56 then enables operation of the shredder mechanism 20 by activating the motor 34 to drive the cutter elements 21 in a shredding direction. The use of an activation sensor 50 is desirable because it allows the user to ready the shredder 10 by moving the switch 100 to its on position, but the controller 56 will not operate the shredder mechanism 20 to commence shredding until the sensor 50 detects the presence or insertion of one ore more articles in the throat 14. Once the at least one article has passed into the shredder mechanism 20 beyond the sensor 50, the controller 56 will then stop the movement or rotation of the cutter elements 21 of shredding mechanism 20, as that corresponds to the articles having been fully fed and shredded. Typically, a slight delay in time, such as 3-5 seconds, is used before stopping the shredder mechanism 20 to ensure that the articles have been completely shredded by the cutter elements 21 and discharged from the shredder mechanism 20. The use of such an activation sensor 50 is beneficial because it allows the user to perform multiple shredding tasks without having the shredder mechanism 20 operating, making noise, between tasks. It also reduces wear on the shredder mechanism 20, as it will only operate when substrates are fed therein, and will not continually operate.

Figure 10:
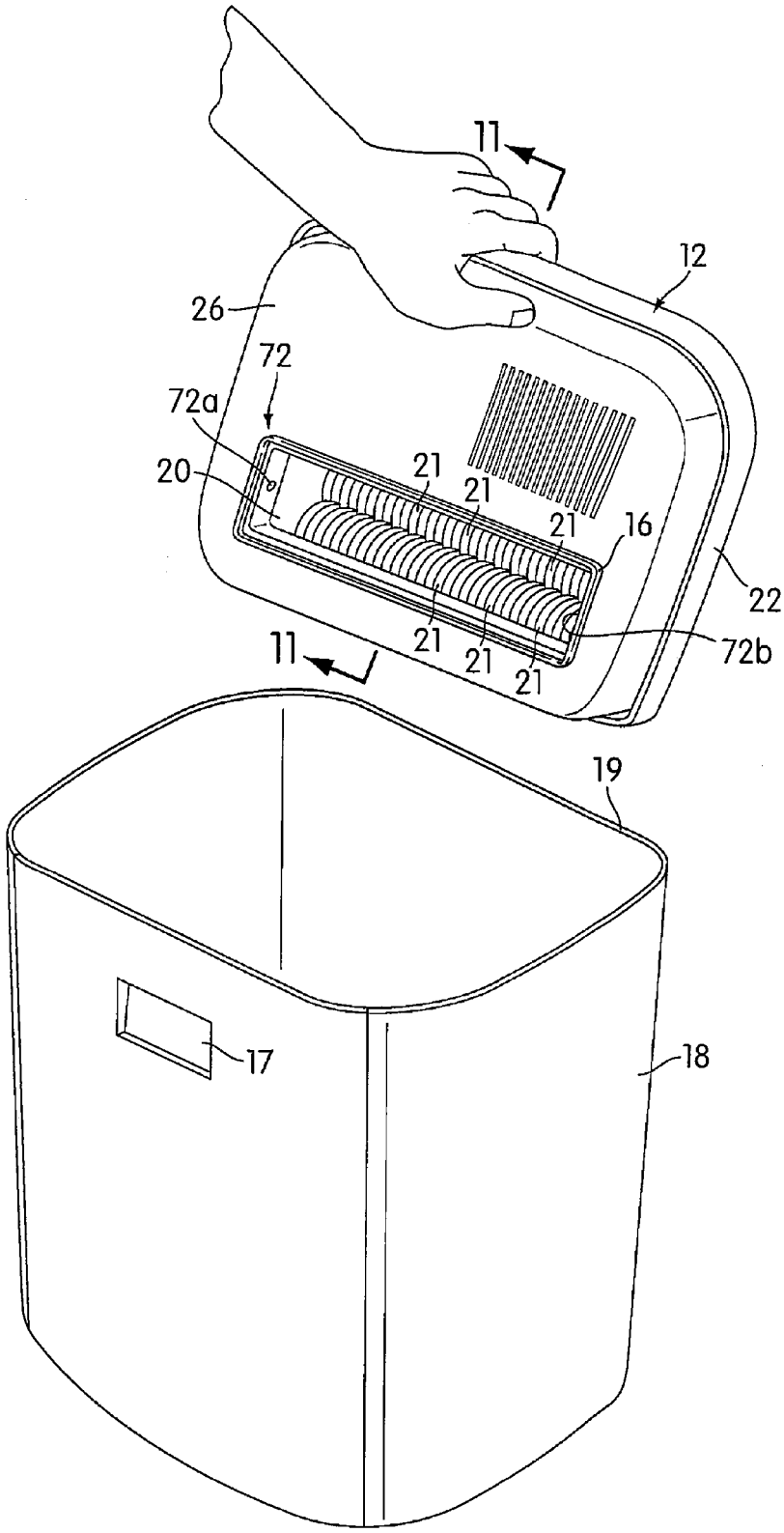
FIG. 10 is a detailed perspective view of a lower side of a shredder housing of a shredder apparatus including at least one sensing device in accordance with an embodiment of the present invention.
Figure 11:
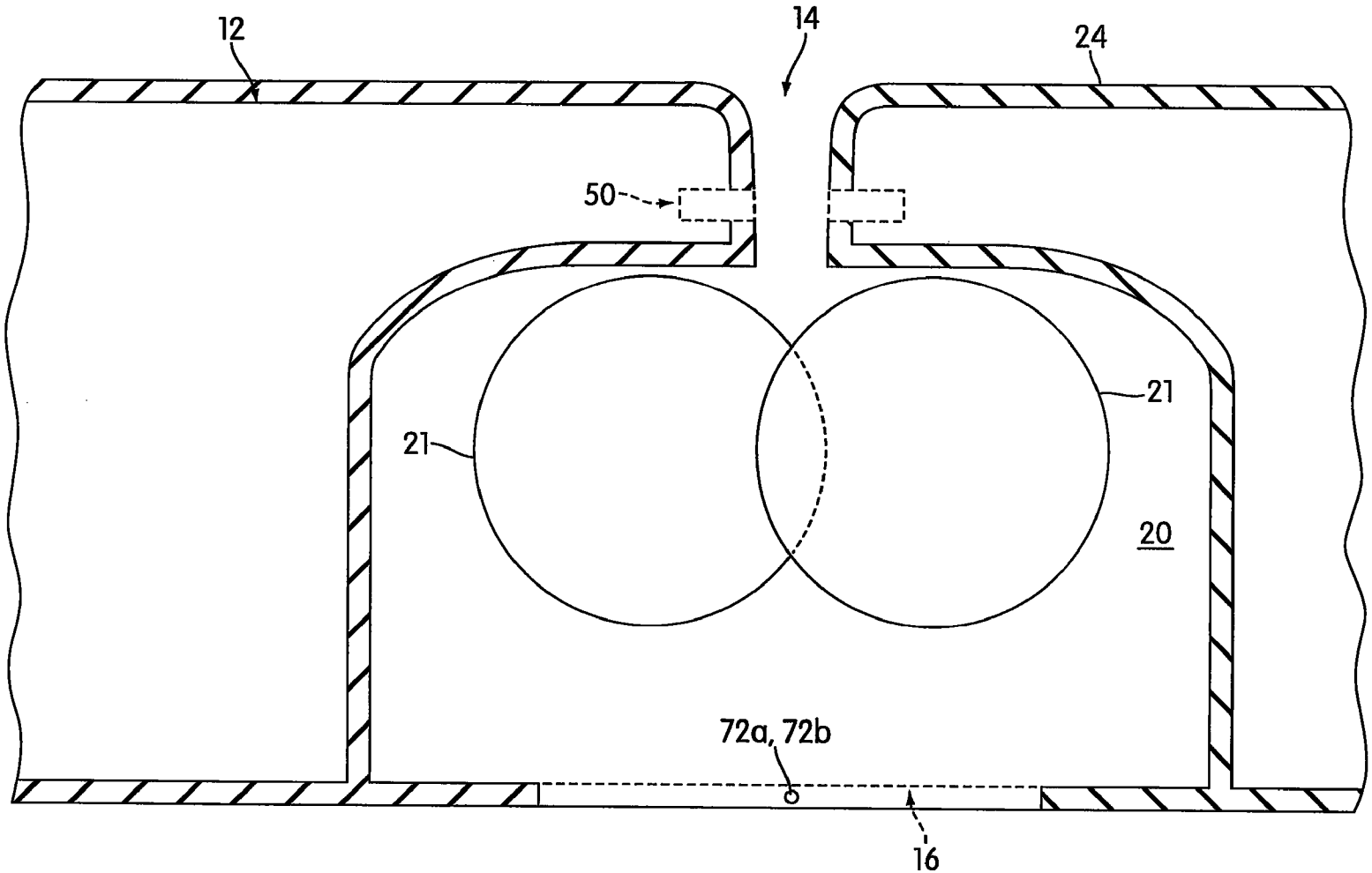
FIG. 11 is a cross-section of FIG. 10 showing a schematic illustration of the at least one sensor operable to detect the presence of shredded particles in accordance with an embodiment of the present invention.

In some embodiments, shredder 10 may comprise one or more waste level or bin full sensing device 72. An example of one type of sensing device 72 is illustrated in FIGS. 10 and 11. The sensor 72 comprises at least one emitter 72*a* positioned to emit radiation. At least one receiver 72*b* is provided to receive and detect the radiation from the emitter 72*a*. In some embodiments, the at least one emitter 72*a* and receiver 72*b* are positioned on the housing 12. In some embodiments, a plurality of receivers and a plurality of emitters may be mounted in relation to the shredder housing 12. The plurality of receivers and/or plurality of emitters may be arranged in a spaced apart relation. The radiation emitted by the at least one emitter may include light in the visible spectrum, infrared radiation, and/or ultraviolet radiation. Similarly, the radiation received by the at least one receiver may include light in the visible spectrum, infrared radiation, and/or ultraviolet radiation.

More specifically, as shown in the embodiment of FIG. 10, one or more emitters 72*a* and receivers 72*b* may be provided adjacent the shredder mechanism 20 of the shredder housing 12. FIG. 11 shows in further detail that the shows the emitter 72*a* and receiver 72*b* of sensing device 72 provided adjacent the output opening 16. In some embodiments, the sensing device 72 may be provided near or within the output opening 16. For example, sensing device 72 may comprise a device such as disclosed in U.S. Pat. No. 6,978,954 B2, issued Dec. 27, 2005, and assigned to the same assignee, which is hereby incorporated by reference in its entirety. In some embodiments, the sensing device(s) may be provided on one or more side walls of the container 18, such as near lip 19, for example.

The sensing device 72 of FIGS. 10 and 11, no matter their location, are used to determine if a bin or container 18 is accumulating or is full of shredded particles. For example, as a user shreds articles, shredded particles are discharged by the shredder mechanism 20 through opening 16 (e.g., into container 18). As the shredded particles build up, the sensing device 72 may detect the accumulation or level of shredded particles in the container 18 and thus warn the user or, alternatively, detect that the container 18 is full and thus communicate with the controller 56 to stop operation of the shredder mechanism 20 until the container 18 is at least partially emptied. The "zero position" of a sensing device 72 may then be defined as a position the sensor assumes when the shredder 10 is powered on with no shredded particles being present (e.g., accumulation of shredded particles being detected). Shredded particles being discharged by the shredder mechanism 20 will interrupt the radiation of the sensing device 72. More specifically, as particles fall through the output opening 16, the radiation emitted by emitter 72*a* towards receiver 72*a* is interrupted or broken for a period of time. In a similar manner as described above, the interruption of the radiation is sensed, which communicates the event to the controller 56. Assuming that the switch 100 is in an on (or idle) position, the controller 56 then controls the operation of the shredder mechanism 20 by activating or deactivating the motor 34 for driving the cutter elements 21. The use of waste level/bin full sensor(s) 72 are desirable because the controller 56 will not operate the shredder mechanism 20 when the sensor(s) 72 detect that the accumulation of shredded particles nearly or substantially fills the bin 18. This is beneficial because it also reduces wear on the shredder mechanism 20, as well as assists in preventing potential jamming in the shredder mechanism or output opening 16, as it will only operate when the bin is not full of accumulated particles.

The method of detecting that the bin 18 is full may be performed in a number of ways, including those mentioned in the above-noted '954 patent. For example, as the radiation beam is interrupted or broken, the controller and/or other hardware or software in the shredder 10 may estimate the amount of material being shredded. Such estimation(s) may be made based on the amount of time or number of times the radiation is interrupted using a timer, for example. Logic and/or other operations to estimate the amount of material in the bin 18 may also be used.

Figure 12:
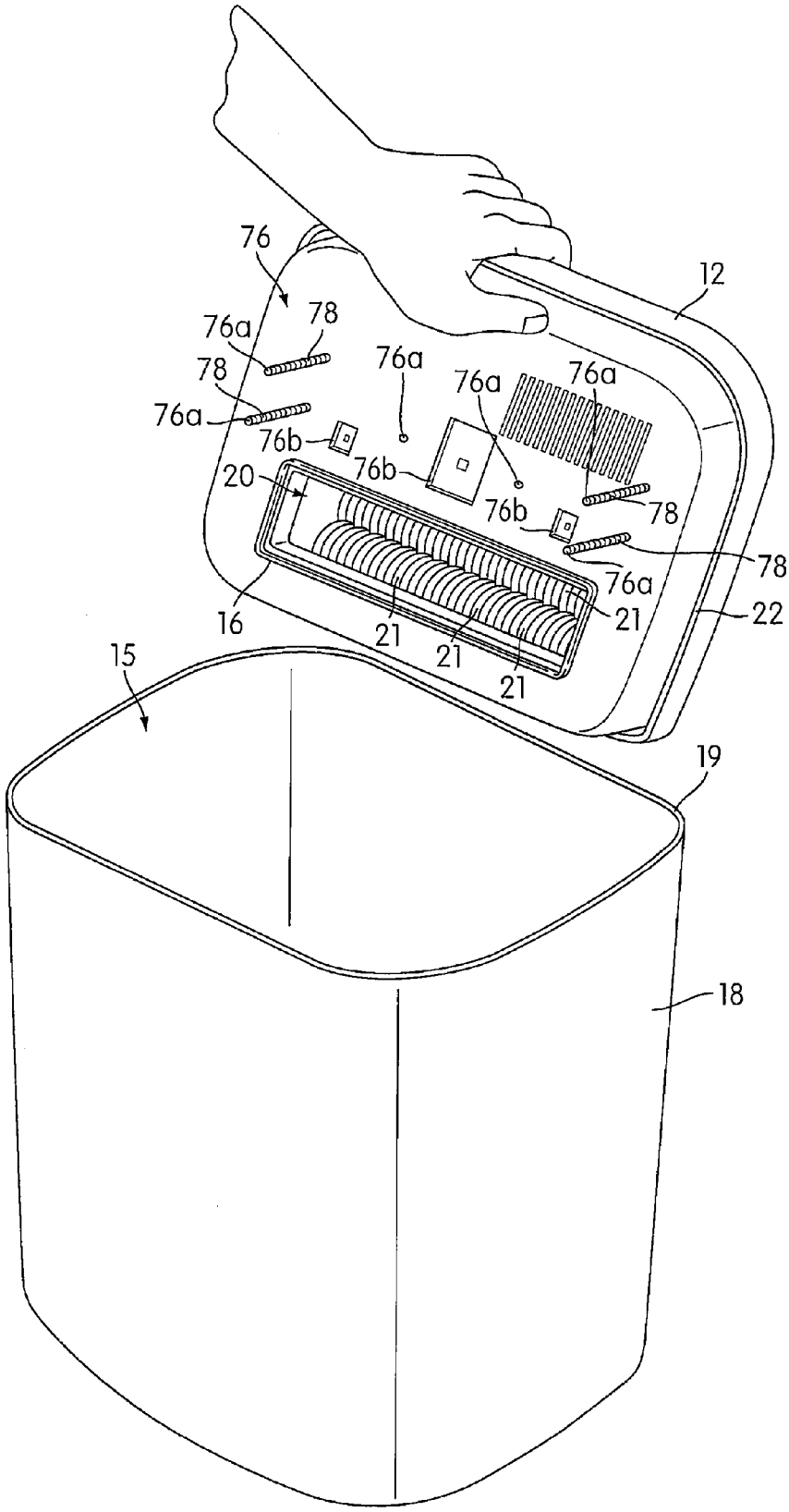
FIG. 12 is a detailed perspective view of a lower side of a shredder housing of a shredder apparatus including one or more sensors in accordance with an embodiment of the present invention.

In some embodiments, shredder 10 may comprise one or more sensing devices 76 as shown in FIG. 12. The sensing devices 76 comprise at least one emitter 76*a* positioned to emit radiation into the bin or container 18. At least one detector or receiver 76*b* to receive the radiation reflected off any shredded material deposited in the bin may also be provided. The one or more receivers 76*b* are configured to determine an intensity of the received reflected radiation, which in turn corresponds to an amount of shredded material deposited in the bin 18. In some embodiments, a plurality of receivers 76*b* and a plurality of emitters 76*a* may be mounted in relation to the shredder housing 12. The plurality of receivers 76*b* and/or plurality of emitters 76*a* may be arranged in a spaced apart relation. The radiation emitted by the at least one emitter may include light in the visible spectrum, infrared radiation, and/or ultraviolet radiation. Similarly, the radiation received by the at least one receiver may include light in the visible spectrum, infrared radiation, and/or ultraviolet radiation.

More specifically, as shown in the embodiment of FIG. 12, one or more waste level/bin full sensing devices 76 may be provided on the bottom wall or lower side 26 of the shredder housing 12. In some embodiments, the sensing device(s) 76 may be provided near or adjacent the output opening 16. For example, it is envisioned that one or more sensing devices 76 may be mounted or provided in a manner such as is disclosed in U.S. patent application Ser. No. 12/184,631, filed Aug. 1, 2008, and assigned to the same assignee, which is hereby incorporated by reference in its entirety. In some embodiments, the one or more emitters 76*a* mounted to the lower side 26 of housing 12 are flush with the bottom wall of the lower side 26. In some embodiments, one or more emitters 76*a* are provided on structures 78 extending downwardly from the bottom wall or lower side 26. Emitters 76*s* may also comprise light-emitting diodes (LEDs). The receivers 76*b* may include windows and/or be mounted in a similar manner (e.g., using a translucent or transparent member to cover a photodetector), as described in the above-noted '631 Application. Alternatively, although not shown, the emitters 76*a* and/or receivers 76*b* may be mounted on one or more side walls of the container 18 or in any other manner so as to emit radiation into the container 18. Thus, the location or mounting of the sensing device(s) 76 should not be limiting.

The sensing device(s) 76 of FIG. 12, no matter their location, are used to determine if a bin or container 18 is accumulating or is full of shredded particles. For example, as a user shreds articles, shredded particles are discharged by the shredder mechanism 20 through opening 16 (e.g., into container 18). As the shredded particles build up, the sensing device 76 may detect the accumulation or level of shredded particles in the container 18 and thus warn the user or, alternatively, detect that the container 18 is full and thus communicate with the controller 56 to stop operation of the shredder mechanism 20 until the container 18 is at least partially emptied.

Because the receivers 76*b* are designed to detect intensity of reflected radiation, and the intensity corresponds to an amount of shredded material deposited in the bin 18, it is important to note the manner in which the sensing devices 76 determine a full or substantially full bin. The receivers 76*b* and emitters 76*s* may use any sort of circuitry, software, logic, computer readable medium, or combination thereof to determine the intensity readings of the reflected radiation in a similar manner as described above (e.g., indirectly proportional). The circuitry and/or logic to determine the intensity readings of the reflected radiation of emitted light note that a change in intensity of emitted light may be directly proportional to the amount of shredded materials in the bin. That is, if a decrease or an increase in intensity is determined, a decrease or an increase, respectively, in the amount of shredded materials in the bin 18 is detected. Specifically, when using emitting and receiving sensing devices 72*a* and 72*b*, a decrease in the intensity of the reflected radiation of the emitted light corresponds to a decrease in the amount of shredded material deposited in the bin. In contrast, an increase in the intensity of the reflected radiation detected by sensing devices 76 in the form of LEDs corresponds to an increase in the amount of shredded material deposited in the bin.

The "zero position" of a sensing device 76 may then be defined as a position the sensor assumes when the shredder 10 is powered on with no shredded particles being present in the bin 18 (e.g., no accumulation of shredded particles being detected). Shredded particles being discharged by the shredder mechanism 20 and into the bin 18 will increase the intensity of the reflected radiation of the sensing device 76. More specifically, as particles fall through the output opening 16, the radiation emitted by emitter 76*a* is reflected off of a top of the accumulated particles in the bin 18 and detected by detector 76*b*. The intensity of the radiation is sensed, and communicates with the controller 56. Assuming that the switch 100 is in an on (or idle) position, the controller 56 may then control the operation of the shredder mechanism 20 by activating, continuing operation, or deactivating the motor 34 for driving the cutter elements 21.

In some embodiments, the emitters 76*a* and receivers 76*b* may be provided as a single sensing device 76; that is, at least one sensor for emitting and receiving radiation may be provided on the bottom wall of the lower side 26 of the housing 12. For example, in an embodiment, the at least one sensing device 76 comprises a single device that alternates between operating in a forward bias mode to emit radiation and a reverse bias mode to detect radiation. In some embodiments, the at least one sensor comprises one or more LEDs. For example, an emitter 76*a* may act as either an independent emitter or a single device used for emitting and detecting radiation.

When using LEDs as sensing devices, the LEDs can detect the presence or absence of shredded materials in the bin 18 in a similar manner as described above. However, the circuitry and/or logic to determine the intensity readings of the reflected radiation used with LEDs may act in a different manner. Specifically, the change in intensity is directly proportional to the amount of shredded materials in the bin. That is, if a decrease or an increase in intensity is determined, a decrease or an increase in the amount of shredded materials in the bin 18 is detected. Specifically, when using LEDs as emitting and receiving sensing devices, a decrease in the intensity of the reflected radiation corresponds to a decrease in the amount of shredded material deposited in the bin. In contrast, an increase in the intensity of the reflected radiation detected by the LEDs corresponds to an increase in the amount of shredded material deposited in the bin.

In some embodiments, one or more activation sensors 50 and/or emitters 52 and detectors 54 may also be provided adjacent to or within throat 14. One or more waste level/bin fall sensing devices 72 or 76 may be provided in addition to or alternative to activation sensor 50, and may also be provided adjacent to, near, or within throat. Generally, any type of bin full sensing devices for emitting and/or detecting radiation known in the art may be used.

The emission and detection of radiation by sensors such as activation sensors 50 or bin fall sensing device 72 or 76 are preferably able to consistently detect a wide range of articles and media as well as detect the presence of a single sheet of paper or shredded particles without providing any false positive signals (e.g., from the controller 56 to the motor 34 of the shredder mechanism 20) during the life of the sensor 50 or 72 or 76. In some embodiments, the emission of radiation from activation sensor 50 and/or bin full sensing device 72 or 76 provides certain levels of intensity (or brightness) of light. However, due to aging, misalignments, variances in tolerances, and/or different sensor grades, the intensity or brightness of the light beam or radiation emitted from the sensors is altered. For example, the intensity of the emitter 52 may decrease due to age and addition of dust or residue on and around the components. A decrease in intensity in indicative of that the sensor's performance is declining. When the perceived intensity of the emitter 52 is reduced (i.e., perceived by the detector 54), false positive signals may be sent from the controller 56, thus creating a "run-on" condition for the shredder 10. When false positive signals occur with sensors detecting the container being full with shredded articles, the shredder mechanism may not run (or it may run when the bin is fall), also causing frustration to users.

In order to compensate for the required characteristics, sensitivities, and other features of the activation sensor 50 or bin full sensing device 72 or 76, the intensity of the radiation emitted by the sensor 50 or 72 or 76 is adjusted and modified so that the sensor is capable of detecting such previously described events. For example, with regard to sensor 50 or 72, the intensity of the radiation beam is adjusted so that the sensor is capable of interruption of the radiation by (a) at least a single sheet of paper being inserted into the throat 14 and/or (b) a plurality of accumulated shredded particles discharged by the shredder mechanism 16. Waste level/bin fall sensing device 76, on the other hand, it adjusted so that the device is capable of accurately detecting an amount of reflected radiation. Specifically, the sensor of the shredder 10 is calibrated to improve its performance.

Figure 6:
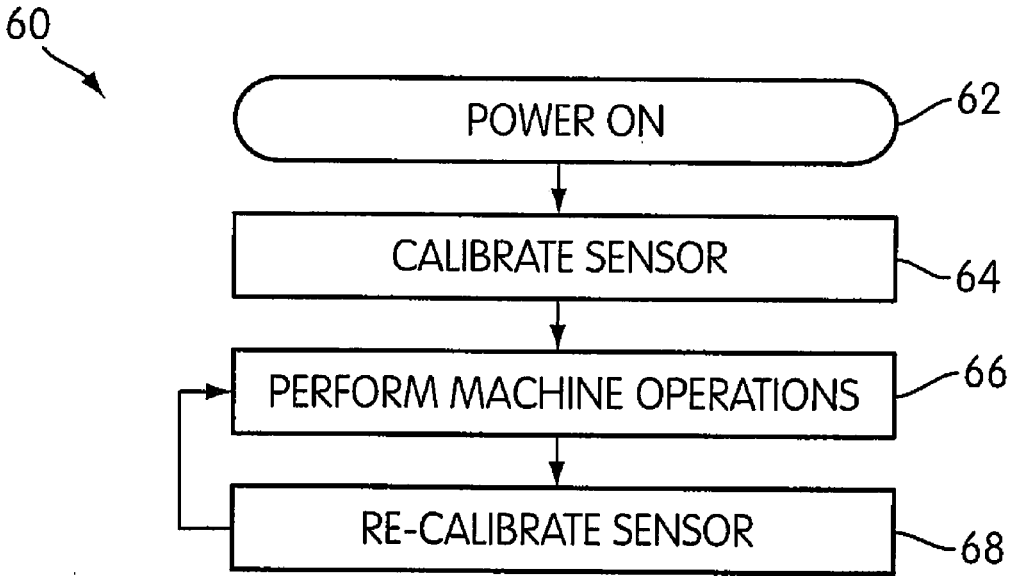
FIG. 6 is a flow chart diagram of a method for calibrating the sensor of FIG. 4 in accordance with an embodiment of the present invention.

For example, FIG. 6 illustrates a method 60 or cycle for operating a shredder with sensor 50 and/or sensing device 72 or 76 in accordance with an embodiment of the present invention. After the shredder is powered on, as represented at 62, the intensity of the radiation from sensor 50 or 72 or 76 is calibrated, as represented at 64. Typical machine operations (e.g., shredding) may then be performed, as noted by 66, for at least one article that is inserted into the throat 14 to be shredded. After the operation of the shredder mechanism 20, the intensity of the radiation may be re-calibrated, as represented at 68.

In order to calibrate and/or recalibrate the intensity of the radiation of sensor 50 and/or sensing device 72 or 76, the controller 56 may provide instructions or signals to sensor 50 and/or 72 and/or 76. For example, the controller 56 may receive a signal to stop the operation of the motor 34, and shortly thereafter perform an automatic calibration of sensor 50 and/or 72 and/or 76. In this case, "automatic" calibration, or automatically performing the method, refers to calibrating the intensity of the radiation after detection (e.g., of paper of shredded particles) by the sensor. In an embodiment, the intensity of the radiation emitted by the sensor is adjusted to or within a predetermined amount above a minimum level detectable by the detector when no article or shredded particles is/are present to interrupt the radiation of the sensor, or when no shredded particles are accumulated in the bin 18.

In the case of an activation sensor such as sensor 50, the level at which the intensity is preferably set may be generally defined as a threshold detection point at which the sensor (or detector 54) is capable of detecting a signal or light beam being emitted (e.g., from emitter 52) that is interrupted by one or more articles, while still being sensitive to detect an interruption by a single article (e.g., a single sheet of paper), being inserted into the throat 14 of the shredder 10. In the case of a bin fall sensing device such as sensing device 72, the level at which the intensity is preferably set may be generally defined as a point at which the sensor detects an interruption of radiation on the accumulated shredded particles being discharged by the shredded mechanism. In the case of a waste level/bin full sensing device such as sensing device 76, the level at which the intensity is preferably set may be generally defined as a point at which the sensor detects radiation reflected off of the accumulated shredded particles in the bin, or reflected off of the bin itself. In some cases, the level at which the intensity is preferably set for any of the sensing devices may be generally defined as a point determined by the controller 56 using rules, logic, computer readable medium, and/or software. The controller 56, therefore, is enabled to modify the intensity of the radiation or light emitted having specific regard to the current light output, desired light output, and variations in light output (e.g., being sent from the emitter 52 to the detector 54).

In an embodiment, the controller 56 may adjust the intensity of radiation by adjusting the drive signal of the emitter 52 of sensing device 50 such that it is calibrated to a point at or within a predetermined amount of a minimum threshold detection level. In some embodiments, drive signal of emitter 52 of activation sensor 50 is configured to emit a series of pulses of light at a set pulse width and a set duty cycle to detector 54 to provide certain levels of intensity of light. However, as the duty cycle of the emitter 52 decreases, the intensity or brightness of the radiation detected by detector 54 also decreases. In such embodiments, the duty cycle is calibrated or modulated to determine the minimum level of intensity of radiation. Such a method may be generally referred to as pulse-width modulation (PWM), for example. Therefore, the controller 56 may be used to change the series of pulses of the duty cycle to provide the desired level of intensity.

Figure 7:
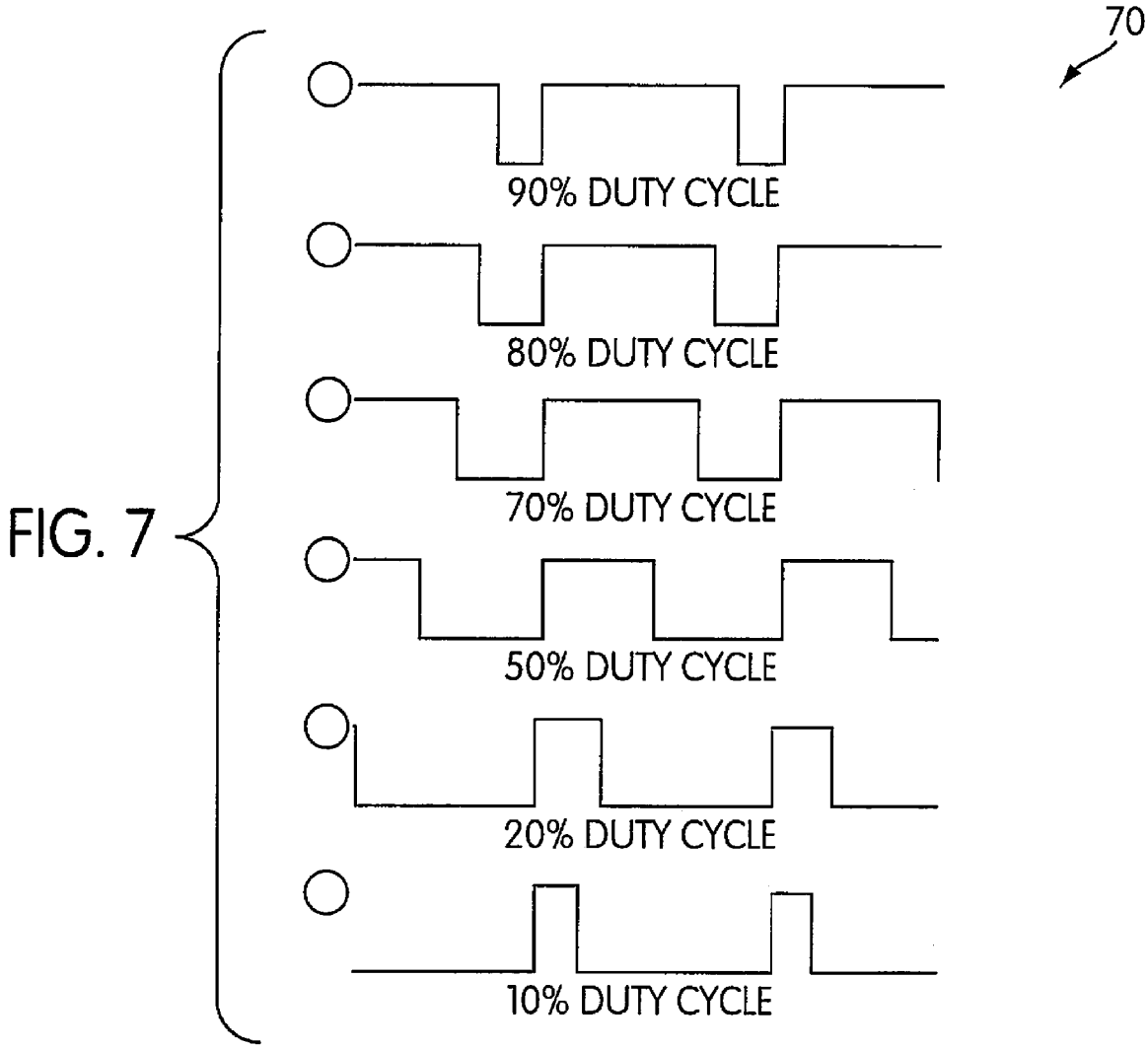
FIG. 7 is an illustration of a plurality of duty cycles for a sensor in accordance with an embodiment of the present invention.

FIG. 7 illustrates an example of a plurality of duty cycles 70 for an activation sensor 50 in accordance with an embodiment of the present invention. The drive signal of the sensor 50 or emitter 52 may be set at any number of duty cycles such as shown by 70 to emit radiation at an specified intensity (to the detector 54). In some embodiments, to calibrate the sensor 50, the duty cycle of drive signal may be adjusted from a selected value to a predetermined amount above a minimum threshold detection level in small decrements. The minimum threshold detection level may be when no article is present in the throat to interrupt the radiation of the sensor. For example, the signal may be reduced from a duty cycle of 100% until the light beam is no longer detected. After reaching such point, the duty cycle of the drive signal may then be slowly increased a predetermined amount until the light beam is just detected (i.e., a threshold detection point). Upon detection, the drive signal is held at the noted duty cycle and the intensity of radiation for the emitter is reached. Alternatively, the duty cycle of the drive signal may be adjusted from a selected value of 0% to increase the value in small increments until the radiation is detected (i.e., a threshold detection point). The intensity of radiation may then be set at or within a predetermined amount above the minimum threshold detection level or point.

For waste level/bin full sensing device 72, the drive signal of the intensity may be calibrated in a similar manner. Specifically, the sensing device 72 may be adjusted from a selected value to a predetermined amount above a minimum threshold level in small decrements. The minimum threshold level of sensing device 72 may be when no shredded particles are present to interrupt the radiation of the sensor. Of course, the method of adjusting the duty cycle of the drive signal of the radiation emitted by sensor 50 or 72 should not be limiting.

By modulating the duty cycle of the emitted radiation, the perceived intensity or strength is fully controllable. The duty cycle of the emitted radiation is modulated at a high speed so that detection of a single piece of paper or other article or shredded particles interrupting the radiation beam is attainable. Thus, any articles inserted into the throat 14 of the shredder 10 or discharged into container 18 therebelow will then be detected and less run-on or false conditions will occur (such as when the sensing devices accumulate dust from the shredding of articles).

For waste level/bin full sensing device 76, the drive signal of the intensity may be calibrated to emit radiation at a specified intensity such that the sensing device 76 or receiver 76*b* is capable of detecting the reflected radiation. In some embodiments, to calibrate the sensing device 76, the drive signal may be adjusted from a selected value to a predetermined amount above a minimum threshold detection level in small decrements. The minimum threshold level of sensing device 76 may be when no particles are present in the bin 18. For example, the signal may be reduced until the reflected radiation or light beam is no longer detected. After reaching such point, the intensity may then be slowly increased (or decreased) a predetermined amount until the light beam is just detected (i.e., a threshold detection point), and held at the noted intensity. The intensity of radiation may then be set at or within a predetermined amount above the minimum threshold detection level or point.

The herein-described cycle or method allows for compensation of component aging, slight misalignments, variances in component tolerances, and different component grades, as such features become less relevant for emitting and detecting the light beam by the sensor 50 or sensing device 72 or 76. Also, calibrating the sensing device(s) 50 and/or 72 or 76 aids in substantially eliminating the possible issue of overpowering the drive signal to the point that the sensor 50 would not communicate with controller 56 to activate the shredder mechanism 20 when needed. For example, when a single article (e.g., piece of paper) is inserted into the throat, sensor 50 may communicate with controller 56 to activate the shredder mechanism 20, or, alternatively, sensing devices 72 or 76 would communicate with controller 56 to deactivate the shredder mechanism 20 when it is detected that the container 18 or bin is full of accumulated shredded particles.

Additionally, calibrating the drive signal being emitted may increase the life of activation sensor 50 and/or bin full sensing device 72 or 76. In particular, when an optical sensor is used as an activation sensor 50, the effects of ambient light may be substantially negated. The effects of ambient light on the sensing device 76 which detects reflected radiation may also be negated.

The cycle or method of calibrating the sensors 50 and/or 72 and/or 76, such as the embodiment shown in FIG. 6, may be repeated at any time. For example, in some embodiments, the intensity of radiation of the sensors 50, 72 and/or 76 may be calibrated immediately or automatically after the shredder is powered on. In some embodiments, the calibration may be performed after a predetermined amount of inactivity of the shredder mechanism 20, during a sleep mode (e.g., when the shredder 10 limits the amount of power being sent to its components), immediately after a shred operation, or before, during, or after other operations.

Figure 13:
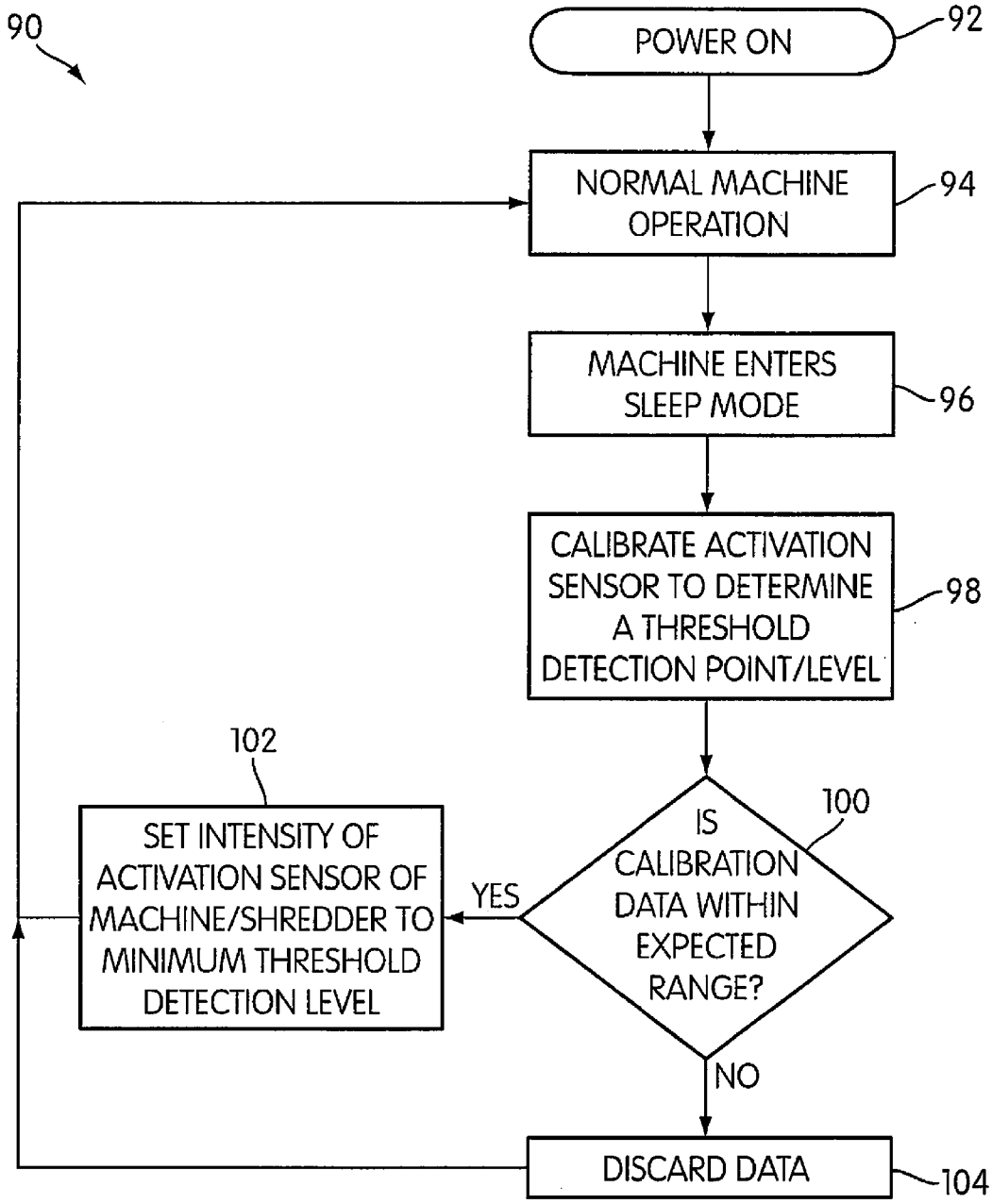
FIG. 13 illustrates a flow chart diagram illustrating a method of determining the need to perform a calibration of an activation sensor.

FIG. 13 illustrates an example of a flow chart diagram illustrating a method 90 of determining the need to perform a calibration of an activation sensor 50. After powering on at 92, normal machine operation(s) may be performed, as indicated at 94. At 96, the machine or shredder enters into a sleep mode. At 98, the activation sensor 50 is calibrated to determine a threshold detection point or level. Then, the calibration data is analyzed to determine if it is within an expected range at 100. If the calibration data is within an expected range, i.e., Yes, the activation sensor 50 is calibrated and set to a minimum threshold detection level, as indicated at 102, and normal machine operations may resume, as indicated at 94. If the calibration data is not within an expected range, i.e., No, the detection point/level and data determined at 98 is discarded at 104 and normal machine operations may resume, as indicated at 94, until another event for possible calibration is determined.

Figure 14:
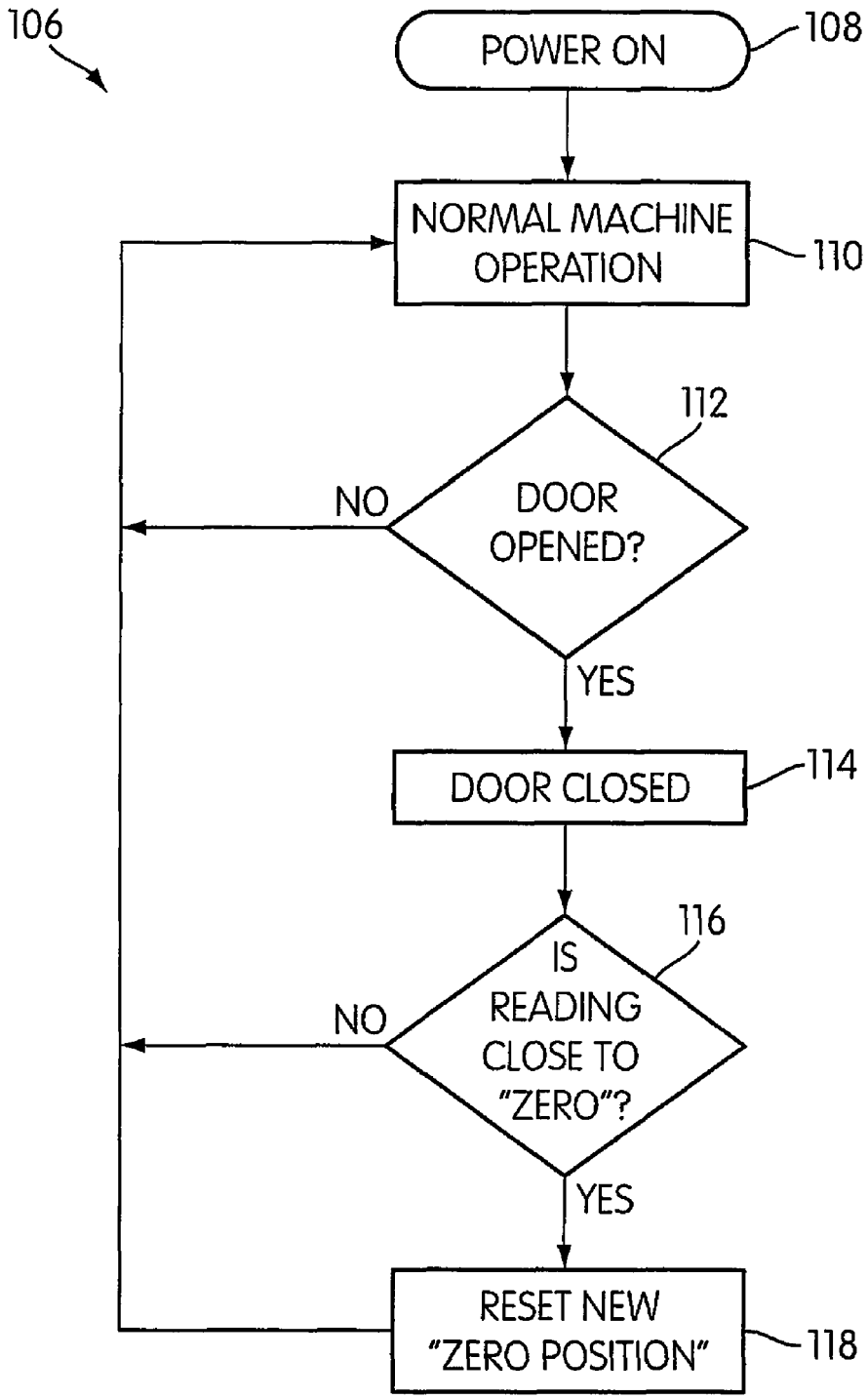
FIG. 14 illustrates a flow chart diagram illustrating a method of determining the need to perform a calibration of a bin full or waste level sensor.

FIG. 14 illustrates a flow chart diagram illustrating a method 106 of determining the need to perform a calibration of a bin full or waste level sensor 72 or 76, for example. After powering on the shredder at 108, normal machine operation (s) may be performed, as indicated at 110. At 112, the machine or shredder determines if a door to the container is opened (or other similar action that separates or stops operation of the motor, for example). If the door is not opened (or that other similar action is not detected), i.e., No, normal machine operations continue at 110. If it is determined that the door is opened (or that other similar action has occurred), i.e., Yes, the method 106 waits until it is determined that the door is closed, as indicated at 114 (or some other action is performed that satisfies the door open or other similar action). At 116, it is determined if the intensity reading of the bin full sensor 72 or 76 is close to a zero position or value. If the position is close to a zero position, i.e., Yes (and most likely no particles are present in the bin or container), the calibration is performed and the intensity of the radiation is set to a new zero position, as indicated at 116. Alternatively, if the reading is not close to a zero position, i.e., No (and most likely particles are present in the bin or container), normal machine operations of the shredder resume, as indicated at 110.

Additionally, it is envisioned that the controller 56 may comprise program code of machine or processor executable instructions in a memory that, when executed, instructs the controller to operate the shredder 10 and calibrate or recalibrate the drive signal of the activation sensor 50 or bin full sensing device 72 or 76 when appropriate.

In some embodiments, the cycle may be aborted if it takes longer than a predetermined amount of time or if the differences between the calibrations exceed a certain percentage in duty cycle. If an external event occurs that requires action, the calibration cycle or method can be aborted and the required action for the external event can be performed. For example, the shredder 10 (and its parts, e.g., additional sensors and controller 56) may detect a user's hands/fingers within a proximity of the throat 14, detect input on a user interface or display screen, detect paper thickness, or other events, and thereby override the calibration of the sensors 50, 72 or 76 until a next opportunity.

In some instances, the controller 56 may also determine whether the intensity of the sensor is less than (or more than) its previous zero position and requires calibration. If the controller 56 determines that the sensor signal is different than the previously noted zero position, the controller 56 recalibrates the sensor. Generally, the sensors may be calibrated or recalibrated for any number of discrepancies that are found between the zero position and a newly determined position as needed. In some instances, the controller 56 uses rules, logic, and/or software to determine if calibration or recalibration is required. For example, if a first sensor reading determines that a container 18 is substantially empty, yet after a short period of time a second sensor reading determines that the container 18 is substantially full, such logic may be used to note that based on the number of articles that were shredded, the container 18 is most likely not fall and thus a false reading has been made. The intensity of the sensor may then be recalibrated to the most recent zero position, or, alternatively, recalibrated after operation of the shredder mechanism, for example. Additional examples of using logic, codes, etc. are described in further detail below.

Though the above described embodiments generally discuss the use of optical or infrared sensors for activating the shredder mechanism, other sensors other than these sensors may be used for sensors 50 and/or 72 or 76 in the shredder 10. For example, in an embodiment, activation sensors 50, 50*a*, and 50*b* or bin full sensing device(s) 72 or 76 described herein may rely on a single, dual-function device that emits and detects radiation. A light emitting diode (LED) is an example of such a source that may be used for light and/or for acting as an emitter and a detector, for example. Generally, LEDs or single devices may act as sensing devices by alternating between operating in a forward bias mode to emit radiation and a reverse bias mode to detect radiation. The intensity of a single device or LED is provided at a base line voltage. The base line voltage comprises at least a value used to determine a first or starting intensity of radiation being emitted and detected. The base line voltage of a sensor is provided at a zero position by the controller 56. In a similar manner to emitters and detectors, over time, the radiation emitted by LEDs decreases in intensity. According to an embodiment, controller 56 automatically calibrates the intensity of the radiation of a sensor by adjusting the base line voltage to a second intensity. In an embodiment, the controller 56 may include rules, logic, and/or software for compensating for the decreasing in the intensity of the LED(s) by calibrating and/or recalibrating the sensors periodically, such as described above.

When using a plurality of LEDs as activation sensors 50 and/or bin fall sensors 72, the LEDs may be calibrated in a similar manner as noted above. For example, when a plurality of LEDs are provided as bin full sensing devices 72 on the shredder housing 12, logic may be used to determine false positive readings. After an operation, should a first LED determine a 10% higher reading than a second LED, the controller 56 may use such logic to determine calibration is needed, since such a difference in detection of accumulated shredded particles is not likely.

When using a single device or single LED as a bin full sensing device 76 or using LEDs in the form of one or more sensing device(s) 76, the method of calibrating the intensity of the sensor may also be accommodated in any number of ways. As described in U.S. application Ser. No. 12/184,631 noted above, as shredded particles accumulate, the reflected intensity of the sensing device 76 increases. Thus, software, logic, filters, and other methods as known in the art may be used to determine the need for calibration or recalibration, as well as prevent false triggers resulting from dust and other particles.

In addition to preventing false positive signals being sent from the controller 56 to the shredder mechanism 20, calibrating the LEDs may also increase the life the sensors 50 and/or 72 or 76 by keeping it the emission of radiation within a range related to the changes in the intensity of light emitted by the LEDs. In addition, using the controller 56 to calibrate sensors when using LEDs, for example, may be beneficial to distinguish between false errors or the need to recalibrate the sensor to a new zero position. As previously noted, if the controller 56 determines that the sensor signal is less than the previously noted zero position, the controller 56 recalibrates the sensor. In some instances, however, the controller 56 may ignore any offset in the intensity as an error, such as when dust or shredded particles temporarily alter the intensity of the radiation. In some embodiments, the controller may determine an offset and adjust the intensity for the operation or a predetermined period of time before defaulting back to the previous zero position. Also, the controller 56 may be equipped to determine that, after a plurality of adjustments, the intensity of the radiation should be recalibrated.

More specifically, for example, the controller 56 and/or logic, codes, software, computer readable medium, etc., may be used to calibrate a sensor after detecting an emptying process. For example, if the sensing device 76 determines that a bin is full of accumulated particles, the user may empty the bin 18. Additional sensors and/or logic may determine, for example, one or more events that indicate a possible emptying process, including, but not limited to: movement of the container 18, moving the container 18 with respect to or relative to a frame, opening of a frame door, separation of the shredder housing 12 and bin 18, etc. Thereafter, the sensing device 76 may be calibrated. If it is determined that the sensor reading is close to or substantially near the previous zero position, the controller 56 assumes the bin or container 18 has been emptied, and may set the threshold detection level substantially equal to the sensor reading. In some instances, if the sensor reading is not substantially equal to the threshold detection level of the previous zero position, but within a predetermined amount (e.g., a 2% difference), logic may be used to null the intensity or base line voltage to the previous zero position. For example, it may be assumed that such a slight difference is due to dust or small particles. Additionally or alternatively, a substantially large change in a sensor's first and second readings may be determined to indicate an emptying process. The second reading, therefore, may be used to set a new zero position for the base line voltage and therefore the intensity for determining the waste level of the bin 18.

In some instances, the controller 56 may determine that a detected intensity is not accurate and that the sensing device 76 must be calibrated based on previous sensor readings, intensity values stored in memory, etc. For example, once sensing device 76 is calibrated after an emptying process, it may be determined that the second sensor reading is higher than a predetermined amount, or, alternatively, substantially different from a first reading (e.g., 20% difference). Because the controller 56 has determined that an emptying process has occurred, the controller 56 may also determine an approximate outcome for the second sensor reading. That is, the approximate intensity of the reflected radiation after emptying the container 18 is generally known. When such a difference is determined between a first and a second reading, the difference in the first and second readings may be measured to determine if such the second reading is accurate, or, alternatively, mistakenly due to dust and/or other particles. If the reading is determined to be accurate, the sensing device 76 is calibrated to the value determined by the second reading. If the reading is determined to be incorrect, the sensing device 76 is calibrated to the previous or a default base line voltage/zero position.

In some embodiments, calibration may occur during the emptying process. For example, if controller 56 communicates with a sensor that detects the container 18 is separated from shredder housing 12 (or some other similar action for emptying as noted above), controller 56 may calibrate the sensing device 76. Calibrating the sensing device 76 during such a process is beneficial as the intensity will be set when no shredded particles are in the container 18, or near there. In particular, in an embodiment where bin or container 8 may be removed from a frame (e.g., sliding like a drawer therefrom), the base line voltage or intensity setting for sensing device 76 may be determined based on detecting reflected radiation within the empty frame. That is, when the container 18 is substantially removed from the frame, the base line voltage of the sensing device 76 may be adjusted to determine a threshold detection level for the intensity. Also, in some embodiments, after replacement of the container 18, should a reading differ from a reading acquired when the container 18 was substantially removed from the frame during the emptying process, controller 56 may estimate or determine if the reading is accurate, and, if necessary, approximate an amount of dust and/or particles that may be present in the container 18.

Some advantages of using a sensing device 76 include its ability to be calibrated to any desired zero point. In some instances, the threshold detection level of sensing device 76 may be set by a user or manufacturer. For example, should a user find that the bin 18 becomes too fall of shredded particles before a warning is issued or the shredding process is stopped, the user may optionally manually override the default settings and the controller's 56 actions by setting or adjusting the threshold detection point.

Figure 8:
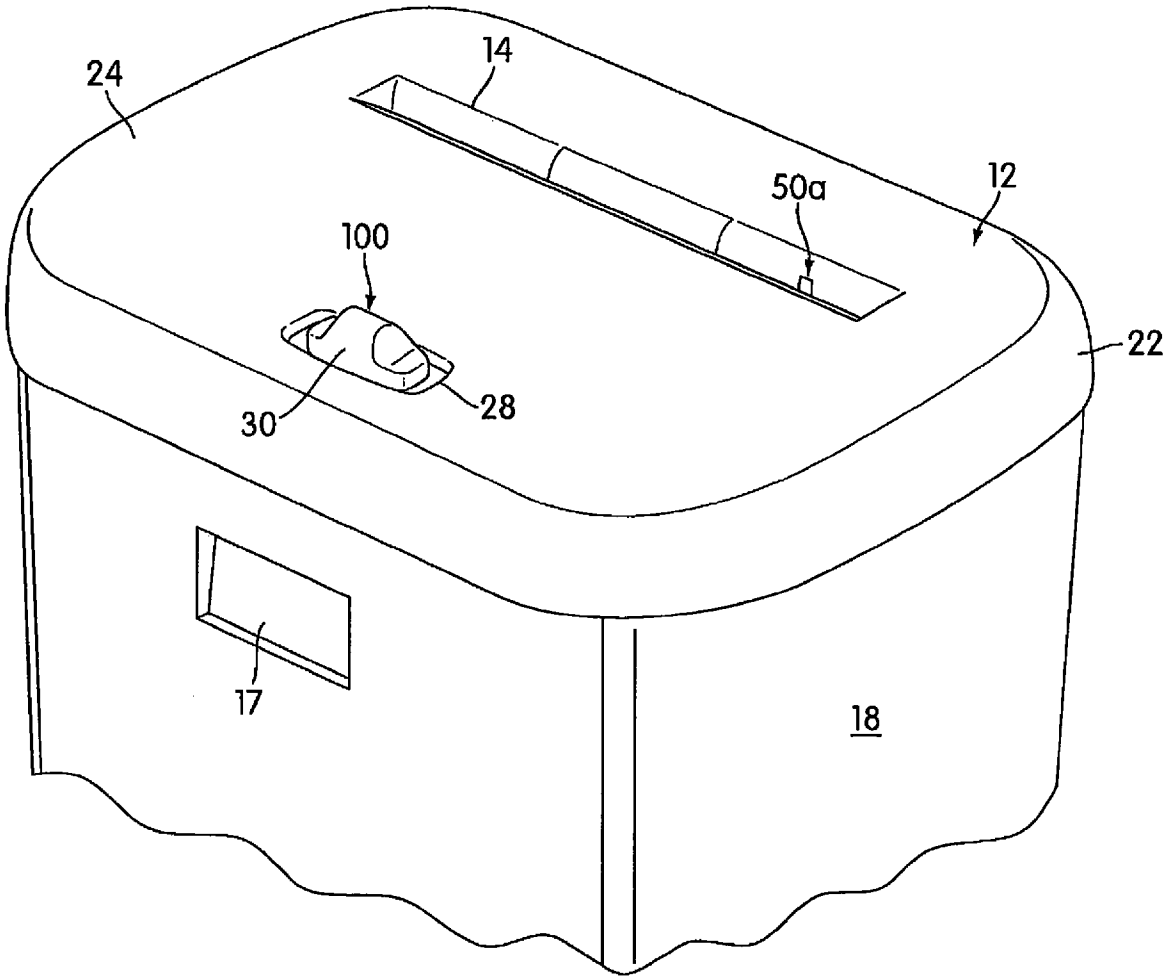
FIGS. 8 and 9 are top perspective views of a shredder apparatus with sensors in alternate locations constructed in accordance with an embodiment of the present invention.
Figure 9:
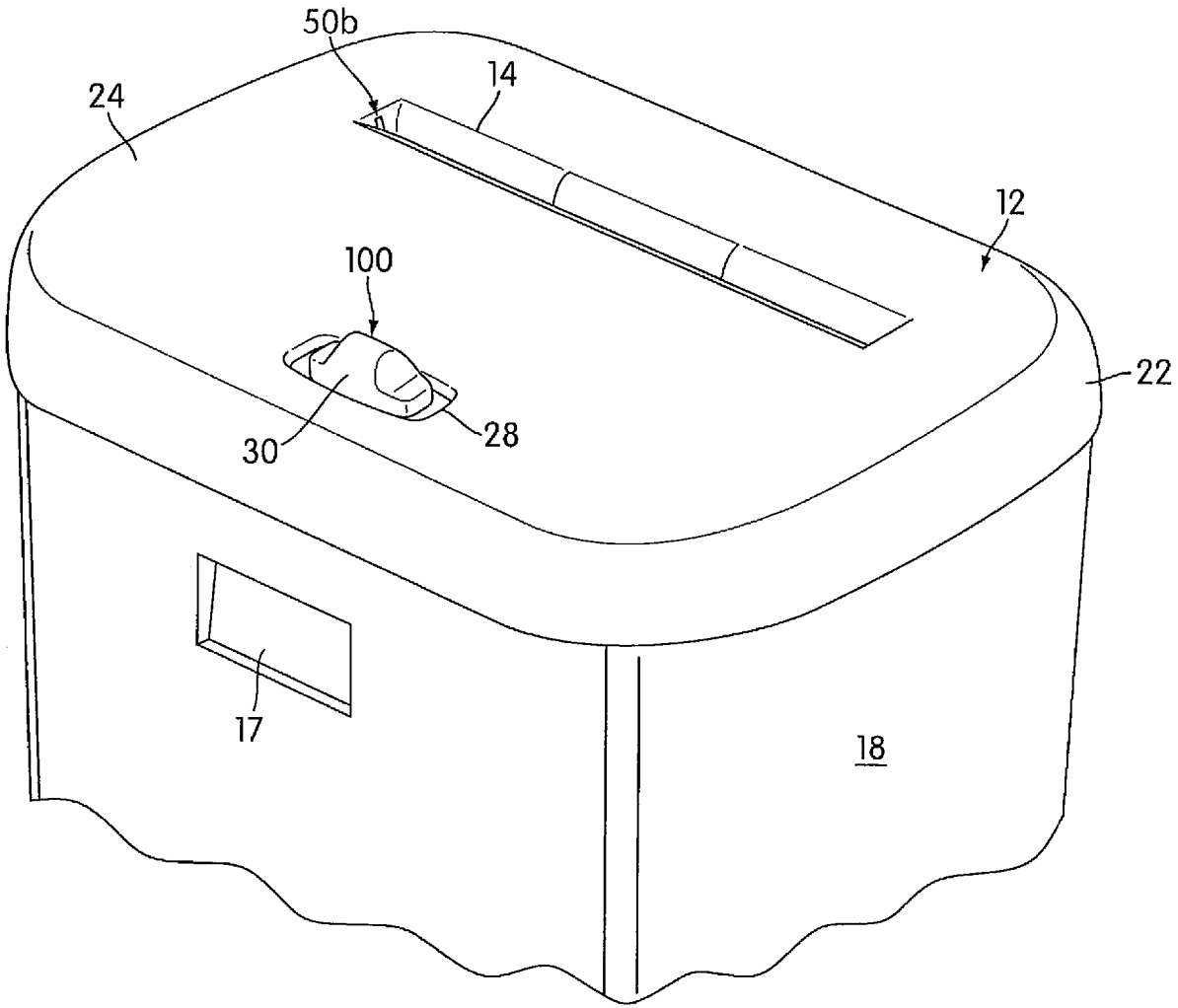

Though FIGS. 3 and 4 illustrate the activation sensor 50 within the center of the throat 14, the sensor may be provided in any number of locations in relation to the throat 14 and should not be limiting. For example, as shown in FIGS. 8 and 9, one or more activation sensors 50*a* and/or 50*b* for detecting the presence of the at least one article to be shredded may be provided in alternate locations in, around, near, or adjacent the throat 14. In some embodiments, activation sensor 50*a* may be provided near a right or left side of the throat 14, for example. In some embodiments, activation sensor 50*b* may be provided on or near an end of the throat 14. In addition, a plurality of sensors (e.g., in the center, below the entrance, on the side, on an end) may be provided in, around, near, or adjacent the throat 14 and are envisioned. Additionally, an activation sensor 50 may be provided in a location above cutter elements 21 in shredder mechanism 20. Also, the location of waste level/bin full sensing devices 72 or 76 should not be limited. Sensing devices 72 or 76 may also be located in, near, or adjacent throat 14.

Additionally, a contact or mechanical member (not shown) may be provided that extends into the throat 14 and is actuated in response to the at least one article being inserted into the throat 14. In an embodiment, the contact or mechanical member (not shown) may be provided to assist in activating the operation of the shredder mechanism 20. Alternatively, the contact member (not shown) may be provided to assist in identifying or indicating the thickness of a stack of articles.

While the principles of the invention have been made clear in the illustrative embodiments set forth above, it will be apparent to those skilled in the art that various modifications may be made to the structure, arrangement, proportion, elements, materials, and components used in the practice of the invention.

The type of shredder 10 that the one or more described sensors and/or calibration method is applied to should not be limiting. Also, the shredder 10 may comprise a shredder mechanism 20 and cutter elements 21 many configurations. The above sensors may be implemented in all cross cut machines and strip cutting machines.

Additionally, one or more sensors 50 and/or 72 and/or 76 may be used in cooperation with one or more other sensor devices in the shredder 10. Such sensor devices may be devices that are capable of, but not limited to, determining a maximum thickness (e.g., to indicate that the thickness of at least one article being inserted into the throat 14 is at least equal to a predetermined thickness), detecting movement of the container 18, detecting shredded materials located in or around the output opening 16, detecting power of the shredder 10 or whether the shredder mechanism 20 is switched on or off, and/or detecting and indicating that the output opening 16 is restricted or closed. Also, sensor devices may be used in cooperation with any number of mechanical, electromechanical, or electric devices.

Additionally, it is envisioned that the method of calibration as described herein may be used with any of type of sensor provided with a shredder. That is, performing the automatic calibration should not be limited to activation sensor(s) and/or bin full sensor(s) and may be applied to any number of sensors used with a shredder. Also, automatic calibration may be performed for any, some, or all of the sensors provided with the shredder.

In some embodiments, any number of visual or audible signals in the form of lights or alarms, for example, may be used in cooperation with the sensors and shredder. For example, it is envisioned that such signals may be used under circumstances such as indicating that the bin is full. Any suitable indicator may be used.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A shredder comprising:

a shredder housing having a throat for receiving at least one article to be shredded therethrough;

a shredder mechanism received in the housing, the shredder mechanism including a motor and cutter elements, the shredder mechanism enabling the at least one article to be shredded to be fed into the cutter elements and the motor being operable to drive the cutter elements in a shredding direction so that the cutter elements shred the at least one article fed therein into particles;

a sensor for emitting and detecting radiation, the sensor being selected from one of the group consisting of (a) a throat sensor operable to detect insertion of the at least one article into the throat based on interruption of the radiation by the at least one article, and (b) a waste level sensor operable to detect an accumulation of shredded particles discharged by the shredder mechanism based on an interruption of the radiation on the accumulated shredded particles;

a controller coupled to the sensor and the shredder mechanism, the controller being operable to control an operation of the shredder mechanism upon detection by the sensor, and the controller being configured to perform an automatic calibration wherein an intensity of the radiation emitted by the sensor is adjusted to or within a predetermined amount above a minimum threshold detection level when no article or shredded particles is/are present to interrupt the radiation of the sensor.

2. A shredder according to claim 1, wherein the intensity of the radiation is defined by a duty cycle, and wherein the automatic calibration includes modulating the duty cycle of the sensor.

3. A shredder according to claim 1, wherein the intensity of the radiation is measured from a base line voltage, the base line voltage comprising at least a value used to determine a first intensity of the radiation, and wherein the automatic calibration includes adjusting the base line voltage to a second intensity.

4. A shredder according to claim 1, wherein the calibration is performed after operation of the shredder mechanism.

5. A shredder according to claim 1, wherein the sensor is provided adjacent to or within the throat.

6. A shredder according to claim 1, wherein the shredder housing has a bottom wall with an output opening thereon, and wherein the sensor is mounted to the bottom wall.

7. A shredder according to claim 1, wherein the sensor comprises an emitter for emitting radiation and a detector for detecting radiation.

8. A shredder according to claim 1, wherein the sensor comprises a single device that alternates between operating in a forward bias mode to emit radiation and a reverse bias mode to detect radiation.

9. A shredder according to claim 8, wherein the sensor comprises one or more light emitting diodes.

10. A shredder according to claim 1, wherein the radiation emitted by the sensor, is selected from the group consisting of: light in the visible spectrum, infrared radiation, and ultraviolet radiation.

11. The shredder according to claim 1, wherein the motor rotates the cutter elements in an interleaving relationship for shredding articles fed therein through the input opening.

12. A shredder according to claim 1, further comprising a container for receiving the at least one shredded article or shredded particles.

13. A shredder according to claim 1, wherein the shredder comprises an additional sensor for detecting and emitting radiation, the additional sensor being a different type than the sensor and selected from the group consisting of (a) a throat sensor operable to detect insertion of the at least one article into the throat based on interruption of the radiation by the at least one article, and (b) a waste level sensor operable to detect an accumulation of shredded particles discharged by the shredder mechanism based on an interruption of the radiation on the accumulated shredded particles, and wherein the controller is coupled to both of the sensors to perform the automatic calibration.

14. A method for operating a shredder, the shredder comprising a shredder housing having a throat for receiving at least one article to be shredded, a sensor for emitting and detecting radiation, the sensor being selected from one of the group consisting of (a) a throat sensor operable to detect insertion of the at least one article into the throat based on interruption of the radiation by the at least one article, and (b) a waste level sensor operable to detect an accumulation of shredded particles discharged by a shredder mechanism based on interruption of the radiation by the accumulated shredded particles, and the shredder mechanism being received in the shredder housing and including a motor being operable to drive cutter elements in a shredding direction so that the cutter elements shred the at least one article fed therein into particles, the method comprising:

emitting and detecting a radiation beam with the sensor;

detecting with the sensor the at least one article or the shredded particles based on an interruption of the radiation beam by the at least one article or the shredded particles;

operating the motor to drive the cutter elements in a shredding direction, and performing an automatic calibration of the radiation beam wherein an intensity of the radiation emitted by the sensor is adjusted to or within a predetermined amount above a minimum threshold detection level.

15. A method according to claim 14, wherein the intensity of the radiation beam is defined by a duty cycle, and wherein the automatic calibration includes modulating the duty cycle of the sensor.

16. A method according to claim 14, wherein the intensity of the radiation beam is measured from a base line voltage comprising at least a value used to determine a first intensity of the radiation beam, and wherein the automatic calibration includes adjusting the base line voltage to a second intensity.

17. A method according to claim 14, wherein performing the automatic calibration further comprises:

setting the intensity of the radiation emitted by the sensor to a selected level, and adjusting the level of the intensity until the minimum level detected by the sensor for the at least one article or the shredded materials being present is determined.

18. A method according to claim 17, wherein the adjusting of level of the intensity comprises increasing a level of intensity from the selected level.

19. A method according to claim 17, wherein the adjusting of level of the intensity comprises decreasing a level of intensity from the selected level.

20. A method according to claim 17, wherein the calibration is performed after operation of the shredder mechanism.

21. A method according to claim 17, wherein the calibration is performed after a selected number of operations of the shredder mechanism.

22. A method according to claim 17, wherein the calibration is performed after period of time during which the shredder mechanism has not operated.

23. A method according to claim 17, wherein, during calibration, the predetermined amount above a minimum level is compared to a selected value, and, if the amount above the minimum level and the selected value is greater than a predetermined difference, the intensity of the radiation is set to a default level.

24. A method according to claim 17, wherein the calibration is aborted due to an external event requiring action by the controller.

25. A method according to claim 14, wherein the shredder comprises an additional sensor for detecting and emitting radiation, the additional sensor being a different type than the sensor and selected from the group consisting of (a) a throat sensor operable to detect insertion of the at least one article into the throat based on interruption of the radiation by the at least one article, and (b) a waste level sensor operable to detect an accumulation of shredded particles discharged by the shredder mechanism based on an interruption of the radiation on the accumulated shredded particles, and wherein the method further comprises performing the automatic calibration of the sensor and the additional sensor.

26. A shredder comprising:

a shredder housing having a throat for receiving at least one article to be shredded therethrough;

a shredder mechanism received in the housing, the shredder mechanism including a motor and cutter elements, the shredder mechanism enabling the at least one article to be shredded to be fed into the cutter elements and the motor being operable to drive the cutter elements in a shredding direction so that the cutter elements shred the at least one article fed therein into particles;

a container for receiving shredded particles;

a sensor positioned to receive radiation reflected off of the shredded particles deposited in the container and determine an intensity of the reflected radiation, the intensity corresponding to an amount of shredded particles deposited in the bin;

a controller coupled to the sensor and the shredder mechanism, the controller being operable to control an operation of the shredder mechanism upon detection by the sensor, and the controller being configured to adjust the intensity of the radiation received by the sensor to or within a predetermined amount at or above a minimum threshold detection level when a condition of the shredder is satisfied.

27. A shredder according to claim 26, wherein the condition is defined by movement of the container relative to the shredder housing.

28. A shredder according to claim 27, wherein the condition is defined by an offset in the intensity of the reflected radiation determined by the sensor when compared to the minimum threshold detection level.

29. A shredder according to claim 26, wherein the shredder housing has a bottom wall and the sensor is mounted to the bottom wall to detect shredded particles in the container.

30. A shredder according to claim 26, wherein the intensity of the radiation is measured from a base line voltage, the base line voltage comprising at least a value used to determine a first intensity of the radiation, and wherein the adjusting the intensity includes adjusting the base line voltage to a second intensity.

31. A shredder according to claim 26, wherein the adjusting of the intensity is performed after operation of the shredder mechanism.

32. A shredder according to claim 26, wherein the sensor comprises an emitter for emitting radiation and a detector for detecting radiation.

33. A shredder according to claim 26, wherein the sensor comprises one or more light emitting diodes.

* * * * *